US009639009B2

(12) United States Patent
Yamaguchi et al.

(10) Patent No.: US 9,639,009 B2
(45) Date of Patent: May 2, 2017

(54) ELECTROPHOTOGRAPHIC MEMBER, PROCESS CARTRIDGE, AND ELECTROPHOTOGRAPHIC APPARATUS

(71) Applicant: CANON KABUSHIKI KAISHA, Tokyo (JP)

(72) Inventors: Sosuke Yamaguchi, Susono (JP); Masaki Yamada, Mishima (JP); Hideya Arimura, Suntou-gun (JP); Kazuhiro Yamauchi, Suntou-gun (JP); Satoru Nishioka, Suntou-gun (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 99 days.

(21) Appl. No.: 14/715,033

(22) Filed: May 18, 2015

(65) Prior Publication Data

US 2015/0331341 A1 Nov. 19, 2015

(30) Foreign Application Priority Data

May 16, 2014 (JP) ..... 2014-102661
May 12, 2015 (JP) ..... 2015-097741

(51) Int. Cl.
*G03G 15/02* (2006.01)
*G03G 15/08* (2006.01)
*G03G 5/043* (2006.01)

(52) U.S. Cl.
CPC ..... *G03G 5/043* (2013.01); *G03G 15/0233* (2013.01); *G03G 15/0818* (2013.01)

(58) Field of Classification Search
CPC ..... G03G 15/0233
(Continued)

(56) References Cited

U.S. PATENT DOCUMENTS 4,757,344 A * 7/1988 Idenawa ..... G03G 21/1853 399/113
8,846,287 B2 9/2014 Yamada et al.
2011/0177926 A1 7/2011 Kusano et al.

FOREIGN PATENT DOCUMENTS

EP 0 810 492 A2 12/1997
JP 57-5047 A 1/1982
(Continued)

OTHER PUBLICATIONS

European Search Report dated Oct. 30, 2015 in European Application No. 15167855.4.
(Continued)

*Primary Examiner* — Ramsey Zacharia
(74) *Attorney, Agent, or Firm* — Fitzpatrick Cella Harper and Scinto

(57) ABSTRACT

The present invention provides a highly electro-conductive electrophotographic member which contributes to formation of high-quality electrophotographic images while bleeding out of an ion conducting agent is reduced, a process cartridge, and an electrophotographic apparatus. Accordingly, the electrophotographic member according to the present invention includes an electro-conductive mandrel and an electro-conductive layer, wherein the electro-conductive layer contains a resin synthesized from a nitrogen-containing aromatic heterocyclic cation and a compound being able to react with the nitrogen-containing aromatic heterocyclic cation, and an anion; the nitrogen-containing aromatic heterocyclic cation has two substituents bonded to hydroxyl groups; and the substituent bonded to the hydroxyl group is bonded to a nitrogen atom of a nitrogen-containing aromatic heterocycle of the nitrogen-containing aromatic heterocyclic cation.

13 Claims, 3 Drawing Sheets

(58) Field of Classification Search
USPC ..... 399/115, 176
See application file for complete search history.

(56) References Cited

FOREIGN PATENT DOCUMENTS

| | | | |
|---|---|---|---|
| JP | 10-196639 | A | 7/1998 |
| JP | 2005-220317 | A | 8/2005 |
| JP | 2011-32397 | A | 2/2011 |
| JP | 2011-118113 | A | 6/2011 |
| JP | 2012-181370 | A | 9/2012 |

OTHER PUBLICATIONS

U.S. App. No. 14/709,155, filed May 11, 2015. Inventor: Satoru Nishioka, et al.
U.S. Appl. No. 14/715,477, filed May 18, 2015. Inventor: Sosuke Yamaguchi, et al.
U.S. Appl. No. 14/708,981, filed May 11, 2015. Inventor: Masaki Yamada, et al.
U.S. Appl. No. 14/710,579, filed May 12, 2015. Inventor: Hideya Arimura, et al.
U.S. Appl. No. 14/709,013, filed May 11, 2015. Inventor: Kazuhiro Yamauchi, et al.

* cited by examiner

ELECTROPHOTOGRAPHIC MEMBER, PROCESS CARTRIDGE, AND ELECTROPHOTOGRAPHIC APPARATUS

BACKGROUND OF THE INVENTION

Field of the Invention

The present invention relates to an electrophotographic member included in an electrophotographic apparatus, and a process cartridge and an electrophotographic apparatus including the electrophotographic member.

Description of the Related Art

In electrophotographic apparatuses (electrophotographic copiers, fax machines, printers and the like of an electrophotographic type), an electrophotographic photosensitive member (hereinafter also referred to as "photosensitive member") is charged by a charging roller, and is exposed to laser beams and the like to form an electrostatic latent image on the photosensitive member. A toner in a developing container is then applied onto a developing roller with a toner feed roller and a toner control member. Next, the toner is conveyed to a region to be developed with the developing roller. The electrostatic latent image on the photosensitive member is developed in or around the contact portion between the photosensitive member and the developing roller with the toner conveyed to the region to be developed. Subsequently, the toner on the photosensitive member is transferred onto a recording paper by a transferring unit, and is fixed by heat and pressure while the toner remaining on the photosensitive member is removed with a cleaning blade.

In such an electrophotographic apparatus, an electrophotographic member having an electro-conductive layer and used in a developing roller or a charging roller should have an electric resistance of about $10^5$ to $10^9$ Ω through control. The entire electrophotographic member should have a uniform and stable electro-conductivity for a long time. Predetermined electro-conductivity is given to the electro-conductive layer by an electro-conductive agent, e.g., electro-conductive particles such as carbon black or an ion conducting agent such as quaternary ammonium salts. Advantageously, an electro-conductive roller including electro-conductive particles such as carbon black barely contaminates other members in contact with the electro-conductive roller. On the other hand, the electro-conductive particles such as carbon black are difficult to homogeneously disperse, and generation of portions locally having low resistance is not readily prevented. Compared to the electro-conductive roller, an ion conductive roller including an ion conducting agent can reduce uneven electric resistance attributed to uneven dispersion of the electro-conductive agent, and has little portions locally having low resistance. For this reason, such an ion conductive roller used as a developing roller can uniformly develop a developer on the photosensitive member, and such an ion conductive roller used as a charging roller can uniformly charge the surface of the photosensitive member.

On the other hand, the ion conducting agent has migration properties, and therefore readily migrates after a long-term use from the electro-conductive layer to bleed out to the surface thereof. The migration of the ion conducting agent through the electro-conductive layer may change the electro-conductivity of the electrophotographic member after long-term use. The ion conducting agent bled out to the surface of the electro-conductive layer may adhere to the surface of the photosensitive member and the like in contact with the electrophotographic member to degrade the quality of electrophotographic images.

To solve the problem, Japanese Patent Application Laid-Open No. 2011-118113 discloses an ion liquid having two hydroxyl groups for fixing the ion liquid to an urethane resin composition to reduce bleeding out of the ion conducting agent.

Japanese Patent Application Laid-Open No. 2011-32397 discloses a durable antistatic resin having antistatic property overall which is prepared by bonding an active hydrogen-containing ion liquid to the resin via urethane bond or adding a polymerization product of an ion liquid containing an unsaturated ethylene group.

The present inventors have conducted research and found that in an electro-conductive layer including an ion conducting agent having two hydroxyl groups, the ion conducting agent was fixed to the electro-conductive layer to reduce the bleeding out of the ion conducting agent from the electro-conductive layer. However, the fixation of the ion conducting agent might reduce the electro-conductivity of the electro-conductive layer, so that the electro-conductivity required for the electrophotographic member was not attained, thus degrading the quality of electrophotographic images.

SUMMARY OF THE INVENTION

The present invention is directed to providing a highly electro-conductive electrophotographic member which contributes to formation of high-quality electrophotographic images while bleeding out of an ion conducting agent is reduced.

Further, the present invention is directed to providing an electrophotographic apparatus which can stably output high-quality electrophotographic images, and a process cartridge included in such an electrophotographic apparatus.

The present inventors have conducted extensive research to achieve the objects. As a result, the inventors have found that in an electrophotographic member including an electro-conductive layer prepared with an ion conducting agent having a specific structure, the ion conducting agent barely bleeds out, and high electro-conductivity is attained, and thus the inventors have achieved the present invention.

According to one aspect of the present invention, there is provided an electrophotographic member including an electro-conductive mandrel and an electro-conductive layer, wherein the electro-conductive layer contains a resin synthesized from a nitrogen-containing aromatic heterocyclic cation and a compound being able to react with the nitrogen-containing aromatic heterocyclic cation, and an anion; the nitrogen-containing aromatic heterocyclic cation has two substituents bonded to hydroxyl groups; with the proviso that, when a nitrogen-containing aromatic heterocycle in the nitrogen-containing aromatic heterocyclic cation, has only one nitrogen atom, one of the substituents bonds to the nitrogen atom, and the other substituent bonds to a carbon atom in the nitrogen-containing aromatic heterocycle, and when a nitrogen-containing aromatic heterocycle in the nitrogen-containing aromatic heterocyclic cation, has two or more nitrogen atoms, the substituents bond to the two nitrogen atoms in the nitrogen-containing aromatic heterocycle.

According to another aspect of the present invention, there is provided an electrophotographic member including an electro-conductive mandrel and an electro-conductive layer, wherein the electro-conductive layer includes a resin having a structure represented by Structural Formula (1) and an anion:

Structural Formula (1)

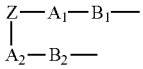

wherein Z represents a cationic skeleton including a cationic nitrogen-containing aromatic heterocycle; $A_1$ and $A_2$ each independently represents a linking group and are bonded to a nitrogen atom of the cationic nitrogen-containing aromatic heterocycle in Z; with the proviso that, when the cationic nitrogen-containing aromatic heterocycle has only one nitrogen atom, one of $A_1$ and $A_2$ bonds to the nitrogen atom, and the other of $A_1$ and $A_2$ bonds to a carbon atom in the cationic nitrogen-containing aromatic heterocycle, and when the cationic nitrogen-containing aromatic heterocycle has two or more nitrogen atoms, $A_1$ and $A_2$ bond to two nitrogen atoms in the cationic nitrogen-containing aromatic heterocycle; and $B_1$ and $B_2$ each independently represents a residue of a reaction of a hydrogen atom in a hydroxyl group with a compound being able to react with the hydrogen atom of the hydroxyl group.

According to further aspect of the present invention, there is provided a process cartridge detachably attachable to a main body of an electrophotographic apparatus, and including at least one of a charging member and a developer carrying member, wherein the charging member or the developer carrying member is the electrophotographic member.

According to further aspect of the present invention, there is provided an electrophotographic apparatus including an electrophotographic photosensitive member, a charging member, and a developer carrying member, wherein the charging member or the developer carrying member is the electrophotographic member.

The present invention can provide a highly electro-conductive electrophotographic member which contributes to formation of high-quality electrophotographic images while bleeding out of an ion conducting agent is reduced if a resin synthesized from a cation having a specific structure and a compound being able to react with the cation is included in an electro-conductive layer. The present invention can also provide a process cartridge and an electrophotographic apparatus which can stably form high-quality electrophotographic images.

Further features of the present invention will become apparent from the following description of exemplary embodiments with reference to the attached drawings.

DESCRIPTION OF THE EMBODIMENTS

Preferred embodiments of the present invention will now be described in detail in accordance with the accompanying drawings.

The electrophotographic member according to the present invention includes an electro-conductive mandrel and an electro-conductive layer, wherein the electro-conductive layer contains a resin synthesized from a nitrogen-containing aromatic heterocyclic cation and a compound being able to react with the nitrogen-containing aromatic heterocyclic cation, and an anion; the nitrogen-containing aromatic heterocyclic cation has two substituents bonded to hydroxyl groups; and the substituent bonded to the hydroxyl group is bonded to a nitrogen atom of a nitrogen-containing aromatic heterocycle of the nitrogen-containing aromatic heterocyclic cation.

Figure 1A:
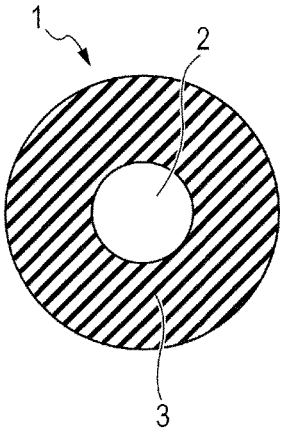
FIG. 1A is a conceptual drawing illustrating an example of an electrophotographic member according to the present invention.
Figure 1B:
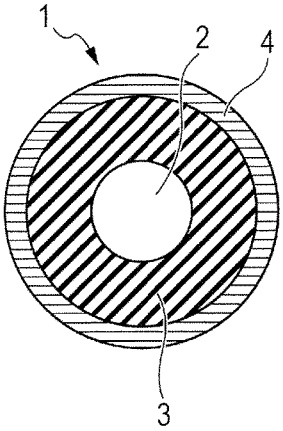
FIG. 1B is a conceptual drawing illustrating another example of an electrophotographic member according to the present invention.
Figure 1C:
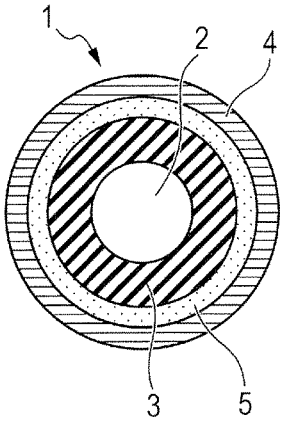
FIG. 1C is a conceptual drawing illustrating still another example of an electrophotographic member according to the present invention.

One embodiment of the electrophotographic member according to the present invention is illustrated in FIGS. 1A, 1B, and 1C. As illustrated in FIG. 1A, the electrophotographic member 1 according to the present invention can include an electro-conductive mandrel 2, and an elastic layer 3 disposed on its outer periphery. In this case, the elastic layer 3 is an electro-conductive layer prepared with the resin according to the present invention. Alternatively, the surface of the elastic layer 3 may have a surface layer 4 as illustrated in FIG. 1B. In this case, the electro-conductive layer according to the present invention can be used in any of the elastic layer 3 and the surface layer 4.

Furthermore, as illustrated in FIG. 1C, the electrophotographic member according to the present invention may have a three-layer structure of an elastic layer 3, an intermediate layer 5, and a surface layer 4 disposed in this order or may have a multi-layer structure including several intermediate layers 5. In this case, the electro-conductive layer according to the present invention can be used as any of the elastic layer 3, the intermediate layer 5, and the surface layer 4.

<Mandrel>

The mandrel 2 functions as an electrode and a supporting member for the electrophotographic member 1. The mandrel 2 is composed of a metal or an alloy such as aluminum, a copper alloy, and stainless steel; iron plated with chromium or nickel; or an electro-conductive material such as an electro-conductive synthetic resin. The mandrel 2 may be solid or may be hollow.

<Electro-Conductive Layer>

In the electrophotographic member according to the present invention, the electro-conductive layer includes a resin synthesized from a nitrogen-containing aromatic heterocyclic cation and a compound being able to react with the cation, and an anion. In the present invention, the resin contained in the electro-conductive layer is prepared with an ion conducting agent. The ion conducting agent indicates a material for preparing a resin contained in the electro-conductive layer, the material having not been reacted with the compound being able to react with a cation. The cation indicates a cation contained in the ion conducting agent and represented by Structural Formula (2):

Structural Formula (2)

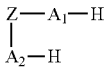

wherein Z represents a cationic skeleton containing a cationic nitrogen-containing aromatic heterocycle; a nitrogen atom in Z is bonded to $A_1$ and $A_2$; $A_1$ and $A_2$ each independently represents a linking group; $A_1$ and $A_2$ each are bonded to a nitrogen atom in Z; and H represents the hydrogen atom of a hydroxyl group.

The substituent bonded to the hydroxyl group can have an oxyalkylene structure between the hydrogen atom of the hydroxyl group and the nitrogen atom.

The oxyalkylene structure can be represented by Formula (I) or (II):

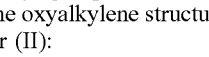

$$**\text{-}(CH_2)_a O\text{-}* \quad (I)$$

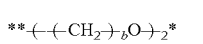

$$**\text{-}((CH_2)_b O)_2\text{-}* \quad (II)$$

wherein * represents a bonding site to the hydrogen atom of the hydroxyl group; ** represents a bonding site to the nitrogen atom; a is an integer of 1 or more and 9 or less; and b is an integer of 1 or more and 4 or less.

In the Structural Formula (2), Z can include at least one skeleton selected from cationic imidazolium skeletons and cationic pyridinium skeletons.

The cation having a structure represented by Structural Formula (2) and the compound being able to react with the cation are essential materials for preparing the resin having a structure represented by Structural Formula (1). The structure represented by Structural Formula (1) indicates a structure after a reaction of the cation according to the present invention and the compound being able to react with the cation. The electro-conductive layer used in the present invention includes the resin having a structure represented by Structural Formula (1) and an anion.

Structural Formula (1)

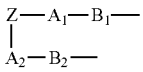

wherein Z represents a cationic skeleton including a cationic nitrogen-containing aromatic heterocycle; $A_1$ and $A_2$ each independently represents a linking group and are bounded to a nitrogen atom of the cationic nitrogen-containing aromatic heterocycle in Z; and $B_1$ and $B_2$ each independently represents a residue of a reaction of the hydrogen atom of the hydroxyl group with a compound being able to react with the hydrogen atom of the hydroxyl group.

$B_1$ and $B_2$ each can include at least one structure selected from urethane bond and ether bond. In the present invention, the cationic organic group indicates Z in the Structural Formula (1) contained in a resin prepared after the reaction of the cation represented by Structural Formula (2).

In Formula (1), the linking groups $A_1$ and $A_2$ can each independently represents an oxyalkylene structure.

The oxyalkylene structure can be a structure represented by Formula (III) or (IV):

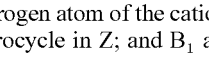

$$**\text{-}(CH_2)_c O\text{-}* \quad (III)$$

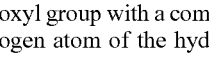

$$**\text{-}((CH_2)_d O)_2\text{-}* \quad (IV)$$

wherein * represents a bonding site to the residue; ** represents a bonding site to the nitrogen atom; c is an integer of 1 or more and 9 or less; and d is an integer of 1 or more and 4 or less.

In the Structural Formula (1), Z can be at least one cation selected from an imidazolium cation (a cationic imidazolium skeleton) and a pyridinium cation (a cationic pyridinium skeleton).

In the Structural Formula (1), $B_1$ or $B_2$ can contain a residue of a reaction of the hydrogen atom of a hydroxyl group with at least one compound selected from isocyanate compounds and melamine compounds.

An electro-conductive layer containing the resin having a structure represented by Structural Formula (1) significantly enhances the electro-conductivity. The present inventors infer the following reason.

First, the inventors infer that the electro-conductivity of the electro-conductive layer mainly depends on the movement of the anion. The cationic organic group Z fixed to the resin barely moves while the anion not bonded to the resin readily moves. Moreover, it seems that the movement of the anion is affected by electrostatic interaction with Z having positive charge. In short, if Z and the anion have strong interaction, the anion is drawn to Z fixed to the resin to barely move, thus reducing the electro-conductivity of the electro-conductive layer. Conversely, if Z and the anion have weak interaction, the anion is barely drawn to Z, and readily moves, thus increasing the electro-conductivity of the electro-conductive layer.

The present inventors infer that advantageous effects of the present invention are achieved by the type of Z in the Structural Formula (1) (cationic skeleton including a cationic nitrogen-containing aromatic heterocycle) and the type of the atom contained in Z bonded to $A_1$ and $A_2$. The details why these two parameters affect the electro-conductivity of the electro-conductive layer will now be described.

First, the reason will now be described why the type of Z affects the electro-conductivity. Unlike the case where Z is not a cationic skeleton including a cationic nitrogen-containing aromatic heterocycle (where Z is a quaternary ammonium cation or a pyrrolidinium cation), if Z is a nitrogen-containing aromatic heterocyclic cationic organic group (such as imidazolium cation or pyridinium cation), positive charge on a nitrogen atom is distributed to other atoms on the aromatic ring from the nitrogen atom due to conjugation. Such distribution reduces the electrostatic interaction between Z and the anion. It seems that the reduced electrostatic interaction readily moves the anion to increase the electro-conductivity.

Secondly, the reason will now be described why the type of the atom in Z bonded to $A_1$ and $A_2$ affects the electro-conductivity of the electro-conductive layer. The cation is fixed to the resin through the reaction of the cation with the compound being able to react with the cation, and is thus incorporated as part of the resin. In the resin after the reaction, Z is bonded through $A_1$ and $A_2$ to other moieties of the resin ($B_1$, $B_2$, and moieties bonded to $B_1$ and $B_2$). The other moieties of the resin ($B_1$, $B_2$, and moieties bonded to $B_1$ and $B_2$) bonded to Z through $A_1$ and $A_2$ cause steric hindrance around the atom in Z bonded to $A_1$ and $A_2$.

A cation having positive charge on a nitrogen atom such as a nitrogen-containing aromatic heterocyclic cation has a higher density of positive charge on the nitrogen atom than on a carbon or hydrogen atom. For this reason, the steric hindrance generated around the nitrogen atom can prevent the anion from approaching to the positive charge of Z. As a result, the anion readily moves in the electro-conductive layer with being barely bound by Z to increase the electro-conductivity.

In contrast, if an atom other than the nitrogen atom in Z is bonded to $A_1$ and $A_2$, the steric hindrance is generated around the atom (other than the nitrogen atom) having a lower density of positive charge while the steric hindrance around the nitrogen atom having a higher density of positive charge is reduced. For this reason, the anion is drawn to the nitrogen atom to barely move, thus reducing the electro-conductivity of the electro-conductive layer.

As described above, the interaction between Z and the anion is weakened by both the aromatic characteristics of Z to distribute the positive charge on the nitrogen atom to other atoms and the steric hindrance generated on the nitrogen atom having a relatively high density of positive charge. As a result, the anion readily moves without being drawn to Z, thus increasing the electro-conductivity of the electro-conductive layer.

<Ion Conducting Agent>

The ion conducting agent used to form the electro-conductive layer has a cation and an anion. The cation has a structure represented by Structural Formula (2):

Structural Formula (2)

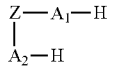

wherein Z represents a cationic skeleton including a cationic nitrogen-containing aromatic heterocycle; $A_1$-H and $A_2$-H each represent a substituent bonded to a hydroxyl group; $A_1$ and $A_2$ each are bonded to a nitrogen atom in Z; and H is the hydrogen atom of a hydroxyl group.

The cationic skeleton can be any nitrogen atom-containing heterocyclic aromatic cation. Examples thereof include imidazolium, pyrazolium, pyridinium, and condensation ring cations formed through condensation of the nitrogen-containing heterocycles of these cations and one or more aromatic rings, such as benzoimidazolium and quinolinium. Examples thereof include cations optionally having one or more heteroatoms other than the nitrogen atom, such as oxazolium, thiazolium, benzooxazolium, and benzothiazolium. Among these cations, preferred are an imidazolium cation and a pyridinium cation, which attain relatively high electro-conductivity of the electro-conductive layer. The cationic skeleton may have one or more optional substituents having no hydroxyl group (such as a hydrocarbon group having 1 to 30 carbon atoms; a halogen group such as fluorine, chlorine, bromine, and iodine; an alkoxy group such as a methoxy group and an ethoxy group; a substituent having a heteroatom such as an amide group and a cyano group; and a haloalkyl group such as a trifluoromethyl group).

In the present invention, the substituent bonded to a hydroxyl group includes a hydrocarbon group or a polyalkylene ether group and a hydroxyl group, and the hydrogen atom of the hydroxyl group is bonded to the cationic skeleton through a linking group. The hydrocarbon group included in the linking group with the oxygen atom of the hydroxyl group is a linear or cyclic, saturated or unsaturated hydrocarbon group having 1 to 30 carbon atoms such as a methylene group, an ethylene group, a propylene group, a butylene group, a pentylene group, a hexylene group, and a phenylene group, and may have one or more heteroatoms such as an oxygen atom, a nitrogen atom, and a sulfur atom. The hydrocarbon group may also have one or more substituents having no hydroxyl group (such as a hydrocarbon group having 1 to 30 carbon atoms; a halogen group such as fluorine, chlorine, bromine, and iodine; an alkoxy group such as methoxy group and an ethoxy group; a substituent having a heteroatom such as an amide group and a cyano group; and a haloalkyl group such as a trifluoromethyl group). Examples of the oxyalkylene group included in the linking group and including a polyalkylene ether group and the oxygen atom of the hydroxyl group include poly(ethylene glycol), poly(propylene glycol), and poly(tetramethylene glycol).

As a result of research, the present inventors have found that the linking group ($A_1$, $A_2$) linking the hydrogen atom of the hydroxyl group to the cationic skeleton can have a length of 10 or less atoms in the shortest distance from the cationic skeleton to the hydrogen atom of the hydroxyl group (9 or less atoms in the shortest distance from the cationic skeleton to the hydroxyl group). For example, if $A_1$ and $A_2$ each are composed of a hydrocarbon group and the oxygen atom of a hydroxyl group and the hydrocarbon group is a nonyl group, these linking groups have 9 atoms in the shortest distance from the cationic skeleton to the hydroxyl group. Namely, the linking group in this case has a structure represented by Formula (V):

$$**-(CH_2)_9O-* \quad (V)$$

wherein * represents a bonding site to a hydrogen atom of a hydroxyl group; ** represents a bonding site to a nitrogen atom of a cationic skeleton; and O represents an oxygen atom of a hydroxyl group.

If $A_1$ and $A_2$ each are a polytetramethylene glycol group and the repetition number is 2, these linking groups have 9 atoms in the shortest distance from the cationic skeleton to the hydroxyl group.

$$**-((CH_2)_4O)_2-* \quad (VI)$$

wherein * represents a bonding site to the hydrogen atom of a hydroxyl group; ** represents a bonding site to a nitrogen atom of a cationic skeleton; and the oxygen atom bonded to * is the oxygen atom of a hydroxyl group.

A linking group having 9 or less atoms in the shortest distance from the cationic skeleton to the hydroxyl group increases steric hindrance generated by the resin reacted with the hydroxyl group, so that the anion barely approaches to the cationic organic group. For this reason, the anion readily moves, attaining an electro-conductive layer having high electro-conductivity.

Examples of the anion in the ion conducting agent include a fluorosulfonic acid anion, a fluorocarboxylic acid anion, a fluorosulfonylimide anion, a fluorosulfonylmethide anion, a fluoroalkylfluoroboric acid anion, a fluoroalkylfluorophosphoric acid anion, a halide ion, a carboxylic acid anion, a sulfonic acid anion, a tetrafluoroboric acid anion, a hexafluorophosphoric acid anion, a hexafluoroarsenic acid anion, a hexafluoroantimonic acid anion, a dicyanamide anion, a bis(oxalato)boric acid anion, a nitric acid anion, and a perchloric acid anion.

Examples of a fluorosulfonic acid anion include a trifluoromethane sulfonic acid anion, a fluoromethanesulfonic acid anion, a perfluoroethylsulfonic acid anion, a perfluoropropylsulfonic acid anion, a perfluorobutylsulfonic acid anion, a perfluoropentylsulfonic acid anion, a perfluorohexylsulfonic acid anion, and a perfluorooctylsulfonic acid anion.

Examples of a fluorocarboxylic acid anion include a trifluoroacetic acid anion, a perfluoropropionic acid anion, a perfluorobutyric acid anion, a perfluorovaleric acid anion, and a perfluorocaproic acid anion.

Examples of a fluorosulfonylimide anion include a trifluoromethanesulfonylimide anion, a perfluoroethylsulfonylimide anion, a perfluoropropylsulfonylimide anion, a perfluorobutylsulfonylimide anion, a perfluoropentylsulfonylimide anion, a perfluorohexylsulfonylimide anion, a perfluorooctylsulfonylimide anion, a fluorosulfonylimide anion, and a cyclic anion such as a cyclo-hexafluoropropane-1,3-bis(sulfonyl)imide.

Examples of a fluorosulfonylmethide anion include a trifluoromethanesulfonylmethide anion, a perfluoroethylsulfonylmethide anion, a perfluoropropylsulfonylmethide anion, a perfluorobutylsulfonylmethide anion, a perfluoropentylsulfonylmethide anion, a perfluorohexylsulfonylmethide anion, and a perfluorooctylsulfonylmethide anion.

Examples of a fluoroalkylfluoroboric acid anion include a trifluoromethyltrifluoroboric acid anion and a perfluoroethyltrifluoroboric acid anion.

Examples of a fluoroalkylfluorophosphoric acid anion include a tris-trifluoromethyl-trifluorophosphoric acid anion, and a tris-perfluoroethyl-trifluorophosphoric acid anion.

Examples of a halide ion include a fluoride ion, a chloride ion, a bromide ion, and an iodide ion.

Examples of a carboxylic acid anion include an alkylcarboxylic acid anion such as an acetic acid anion, a propionic acid anion, a butyric acid anion, and a hexanoic acid anion; and an aromatic carboxylic acid anion such as a benzoic acid anion. These anions may have one or more substituents selected from the group consisting of a hydrocarbon group having 1 to 30 carbon atoms, a halogen group such as a fluorine, a chlorine, a bromine, and an iodine, an alkoxy group such as a methoxy group and an ethoxy group, a substituent containing a heteroatom such as an amide group and a cyano group, and a haloalkyl group such as a trifluoromethyl group.

Examples of a sulfonic acid anion include an alkylsulfonic acid anion such as a methanesulfonic acid anion and an ethanesulfonic acid anion; and an aromatic sulfonic acid anion such as a benzene sulfonic acid and para-toluenesulfonic acid anion. These anions may be substituted with one or more substituents selected from the group consisting of a hydrocarbon group having 1 to 30 carbon atoms, a halogen group such as a fluorine, a chlorine, a bromine, and an iodine, an alkoxy group such as a methoxy group and an ethoxy group, a substituent containing a heteroatom such as an amide group and a cyano group, and a haloalkyl group such as a trifluoromethyl group.

Among these anions, preferred anions for the ion conducting agent are a fluorosulfonic acid anion, a fluorocarboxylic acid anion, a fluorosulfonylimide anion, a fluorosulfonylmethide anion, a fluoroalkylfluoroboric acid anion, a fluoroalkylfluorophosphoric acid anion, a tetrafluoroboric acid anion, a hexafluorophosphoric acid anion, a hexafluoroarsenic acid anion, a hexafluoroantimonic acid anion, a dicyanamide anion, and a bis(oxalato)boric acid anion to attain high electro-conductivity of the electro-conductive layer.

The ion conducting agent can be compounded in an amount of 0.01 parts by mass or more and 20 parts by mass or less relative to 100 parts by mass of the electro-conductive layer. An amount of 0.01 parts by mass or more can attain an electro-conductive layer having high electro-conductivity. An amount of 20 parts by mass or less can attain an electro-conductive layer from which the ion conducting agent barely bleeds out.

<Compound being Able to React with Cation>

The compound being able to react with a cation indicates a compound having two or more functional groups reactive to a hydroxyl group. The compound being able to react with a cation may react with not only hydroxyl groups of the cation in the ion conducting agent but also hydroxyl groups contained in polyol described later and other compounds in the electro-conductive layer. Examples of the compound being able to react with a cation include isocyanate compounds having an isocyanate group; epoxide compounds having a glycidyl group; and melamine compounds having an alkoxy group, an imino group, and a methylol group. Examples of the isocyanate compounds include aliphatic polyisocyanates such as ethylene diisocyanate and 1,6-hexamethylene diisocyanate (HDI); alicyclic polyisocyanates such as isophorone diisocyanate (IPDI), cyclohexane-1,3-diisocyanate, and cyclohexane-1,4-diisocyanate; aromatic isocyanates such as 2,4-tolylene diisocyanate, 2,6-tolylene diisocyanate (TDI), 4,4'-diphenylmethane diisocyanate (MDI), polymeric diphenylmethane diisocyanate, xylylene diisocyanate, and naphthalene diisocyanate; and copolymerization products, isocyanurate products, TMP adducts, and biurets thereof, and block products of these. Examples of epoxide compounds include aliphatic diepoxides such as 1,4-butanediol diglycidyl ether; and aromatic diepoxides such as bisphenol A diglycidyl ether. Examples of usable melamine compounds include methylated melamines, butylated melamines, iminomelamines, methyl-butyl mixed melamines, and methylol melamines.

Among these compounds, aromatic isocyanates such as tolylene diisocyanate, diphenylmethane diisocyanate, and polymeric diphenylmethane diisocyanate, melamine compounds such as methylated melamines, butylated melamines, iminomelamines, methyl-butyl mixed melamines, and methylol melamines are preferred. These compounds have high reactivity with hydroxyl groups contained in the cation to decrease the proportion of the cation not bonded to the resin. Such compounds can attain an electro-conductive layer from which the ion conducting agent barely bleeds out.

The resin contained in the electro-conductive layer may contain a resin synthesized from the compound being able to react with a cation and polyol. Polyol has a plurality of hydroxyl groups in the molecule, and the hydroxyl groups react with the compound being able to react with the cation. Examples thereof include, but should not be limited to, polyether polyol and polyester polyol. Examples of polyether polyol include polyethylene glycol, polypropylene glycol, and polytetramethylene glycol. Examples of polyester polyol include polyester polyols prepared through a condensation reaction of diol components such as 1,4-butanediol, 3-methyl-1,4-pentanediol, and neopentyl glycol or triol components such as trimethylolpropane with dicarboxylic acids such as adipic acid, phthalic anhydride, terephthalic acid, and hexahydroxyphthalic acid. These polyether polyol and polyester polyol may be preliminarily formed in the form of a prepolymer having chains extended by isocyanate such as 2,4-tolylene diisocyanate (TDI), 1,4-diphenylmethane diisocyanate (MDI), or isophorone diisocyanate (IPDI) when necessary.

The electro-conductive layer may contain typical resins other than the resin according to the present invention, rubber materials, compounding agents, electro-conductive agents, non-electro-conductive fillers, crosslinking agents, and catalysts in an extent not to impair the advantageous effects of the present invention. Any resin can be added. Examples thereof include epoxy resins, urethane resins, urea resins, ester resins, amide resins, imide resins, amideimide resins, phenol resins, vinyl resins, silicone resins, and fluorine resins. Examples of the rubber material include ethylene-propylene-diene copolymerization rubber, acrylonitrile-butadiene rubber, chloroprene rubber, natural rubber, isoprene rubber, styrene-butadiene rubber, silicone rubber, epichlorohydrin rubber, and urethane rubber. Examples of the compounding agent include fillers, softening agents, treatment aids, tackifiers, antitack agents, and foaming agents typically used in the resin. Examples of the electro-conductive agent include fine particles of carbon black; electro-conductive metals such as aluminum and copper; and electro-conductive metal oxides such as electro-conductive zinc oxide, electro-conductive tin oxide, and electro-conductive titanium oxide. Examples of the non-electro-conductive fillers include silica, quartz, titanium oxide, and calcium carbonate. Examples of the crosslinking agent include, but should not be limited to, tetraethoxysilane, di-t-butyl peroxide, 2,5-dimethyl-2,5-di(t-butylperoxy) hexane, and dicumyl peroxide.

If the electro-conductive layer according to the present invention is used as the surface layer of the electrophotographic member and needs surface roughness as the surface layer, fine particles can be added to the electro-conductive layer to control the surface roughness. Particularly in use as the surface layer of the developing roller, fine particles for controlling surface roughness can have a volume average particle diameter of 3 to 20 μm to attain a developing roller which carries a developer efficiently. The fine particles can be added to the electro-conductive layer in an amount of 1 to 50 parts by mass relative to 100 parts by mass of the resin solid content of the electro-conductive layer without impairing the advantageous effects of the present invention. Usable fine particles for controlling surface roughness are fine particles of polyurethane resins, polyester resins, polyether resins, polyamide resins, acrylic resins, and phenol resins.

The electro-conductive layer can be formed by any method. Examples thereof include spraying, immersion, and roll coating of coating materials. Japanese Patent Application Laid-Open No. S57-5047 describes an immersion coating method of forming an electro-conductive layer by overflowing a coating material from the top of an immersion tank. These simple methods have high production stability. The electro-conductive layer according to the present invention can be formed as an elastic layer 3 illustrated in FIG. 1A by a known method in the field of the electrophotographic member. Examples thereof include a method of co-extruding a mandrel and a material for an electro-conductive layer; and a method of injecting a liquid material for forming an electro-conductive layer into a metal mold including a cylindrical pipe, bridges disposed on both ends of the pipe to hold the mandrel, and a mandrel, and curing the material by heating.

The electrophotographic member according to the present invention can be used as an electrophotographic member such as a charging member (roller), a developer carrying member (developing roller), a transfer member (roller), and a cleaning blade.

If the electrophotographic member according to the present invention is used as the developing roller of the developing apparatus, the developer may be magnetic or non-magnetic, or may be a one-component developer or a two-component developer. The developing apparatus may be of a non-contact type or a contact type.

<Process Cartridge, Electrophotographic Apparatus>

Figure 2:
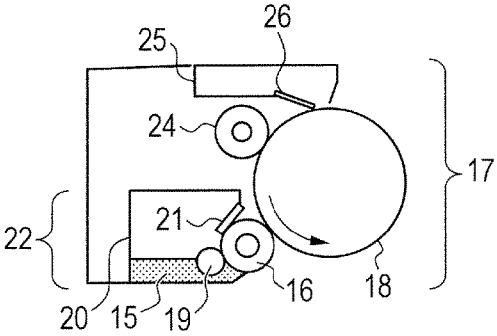
FIG. 2 is a schematic view illustrating a configuration of an example of a process cartridge according to the present invention.

FIG. 2 is a cross sectional view illustrating the process cartridge according to the present invention. A developing roller 16 as a developer carrying member, a developing blade (toner control blade) 21, an electrophotographic photosensitive member 18, a cleaning blade 26, a used toner accommodating container 25, and a charging roller 24 as a charging member are integrated into a process cartridge 17 illustrated in FIG. 2. The process cartridge is detachably attachable to the main body of an electrophotographic image forming apparatus. The developing apparatus 22 includes a toner container 20. The toner container 20 is filled with a toner 15. The toner in the toner container 20 is fed to the surface of the developing roller 16 by a toner feed roller 19, and is formed into a layer of the toner having a predetermined thickness on the surface of the developing roller 16 by the developing blade 21.

Figure 3:
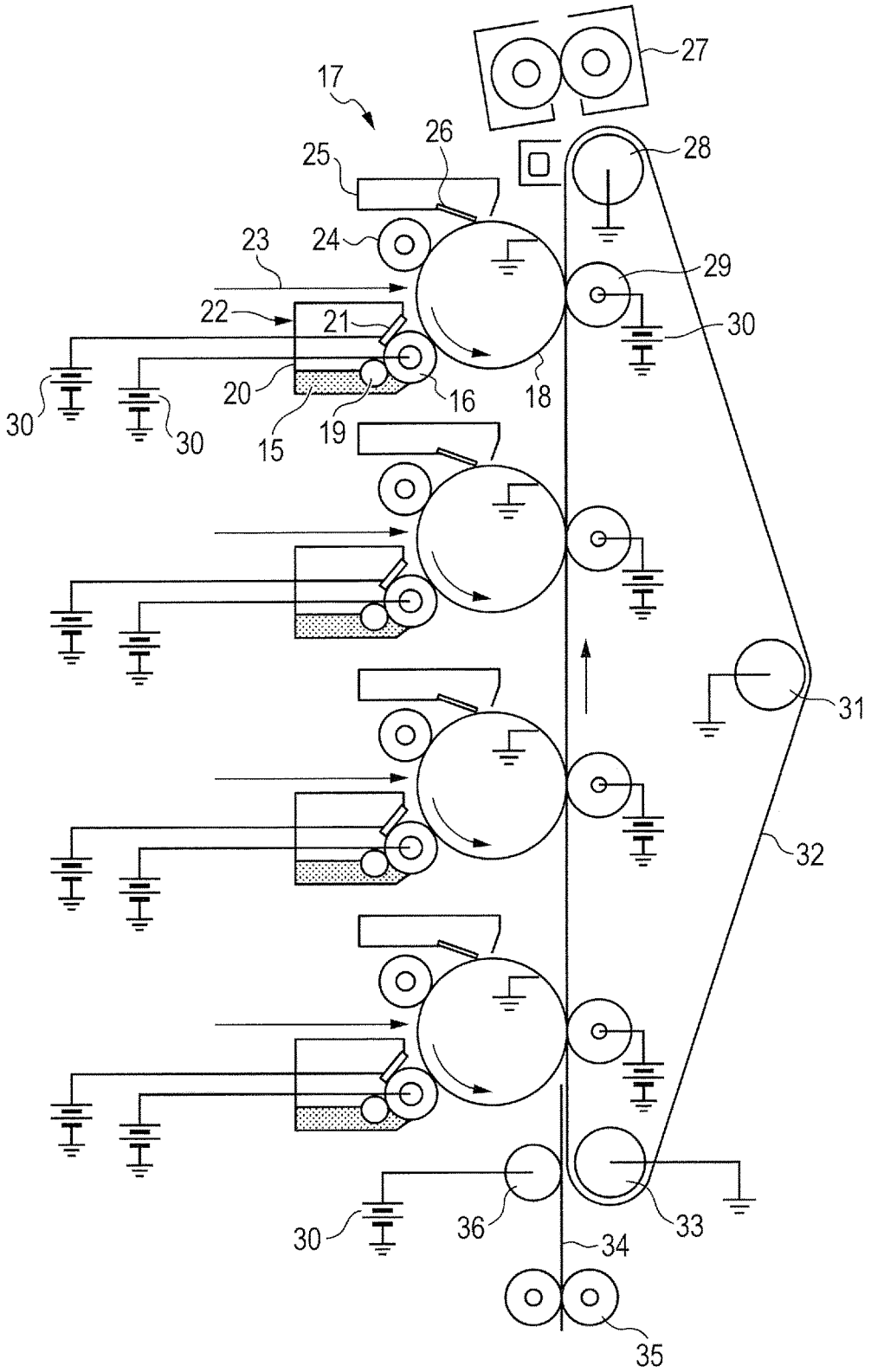
FIG. 3 is a schematic view illustrating a configuration of an example of an electrophotographic apparatus according to the present invention.

FIG. 3 is a cross sectional view illustrating an electrophotographic apparatus including the electrophotographic member according to the present invention as the developing roller 16 as a developer carrying member. The electrophotographic apparatus illustrated in FIG. 3 includes a developing apparatus 22 detachably attached thereto. The developing apparatus 22 includes a developing roller 16, a toner feed roller 19, a toner container 20 which can accommodate the toner 15, and a developing blade 21. The electrophotographic apparatus also includes a process cartridge 17 detachably attached thereto. The process cartridge 17 includes a photosensitive member 18, a cleaning blade 26, a used toner accommodating container 25, and a charging roller 24. Only the developing apparatus 22 may be detachably attached to the electrophotographic apparatus, or the developing apparatus 22 and the process cartridge 17 may be integrated and detachably attached to the electrophotographic apparatus. Alternatively, the developing apparatus 22, the photosensitive member 18, the cleaning blade 26, the used toner accommodating container 25, and the charging roller 24 may be disposed in the main body of the electrophotographic apparatus. Namely, the process cartridge according to the present invention may have at least one of the charging roller 24 as a charging unit and the developing roller 16 as a developing unit, and may be detachably attachable to the main body of the electrophotographic apparatus.

The photosensitive member 18 rotates in the arrow direction, is uniformly charged by the charging roller 24 for charging the photosensitive member 18. An electrostatic latent image is formed on the surface of the photosensitive member 18 by laser beams 23 from an exposing unit for writing an electrostatic latent image on the photosensitive member 18. A toner is given to the electrostatic latent image by the developing apparatus 22 disposed in contact with the photosensitive member 18 to develop the electrostatic latent image to be visualized as a toner image.

The electrostatic latent image is subjected to reverse developing to develop a toner image on the exposed portion. The visualized toner image on the photosensitive member 18 is transferred onto a paper 34 as a recording medium by a transfer roller 29 as a transfer member. The paper 34 is fed through a paper feed roller 35 and an adsorption roller 36 into the apparatus, and is conveyed between the photosensitive member 18 and the transfer roller 29 by an endless transfer conveying belt 32. The transfer conveying belt 32 is driven by a following roller 33, a driving roller 28, and a tension roller 31. Voltage is applied to the transfer roller 29 and the adsorption roller 36 from a bias power supply 30. The paper 34 having a transferred toner image thereon is fixed by a fixing apparatus 27, and is ejected from the apparatus. The print operation is completed.

The toner remaining on the photosensitive member 18 without being transferred onto the paper 34 is scraped off by the cleaning blade 26, and is accommodated in the used toner accommodating container 25.

The developing apparatus 22 includes a toner container 20 accommodating a toner 15 as a one-component developer, and a developing roller 16 as a developer carrying member disposed in an opening extending in the longitudinal direction of the toner container 20 and facing the photosensitive member 18. The developing apparatus 22 develops the electrostatic latent image on the photosensitive member 18 for visualization. Voltage is applied to the developing roller 16 and the developing blade 21 from the bias power supply 30.

EXAMPLES

Examples, in which the electro-conductive layer according to the present invention is used as the surface layer 4 of the electrophotographic member 1 as illustrated in FIG. 1B, and Comparative Examples will now be described in detail, but the present invention will not be limited to these Examples.

(Preparation of Elastic Roller D-1)

A primer (trade name, DY35-051; available from Dow Corning Toray Silicone Co., Ltd.) was applied to a metal core made of SUS304 and having a diameter of 6 mm and a length of 278.9 mm, and was baked in an oven heated to 180° C. for 20 minutes to prepare a mandrel.

The mandrel was placed in a metal mold, and an addition type silicone rubber composition containing the following materials was injected into the cavity of the metal mold.

- liquid silicone rubber material (trade name, SE6724A/B; available from Dow Corning Toray Silicone Co., Ltd.) 100 parts by mass
- carbon black (trade name, TOKABLACK #4300; available from Tokai Carbon Co., Ltd.) 15 parts by mass
- silica powder as a heat-resistance agent 0.2 parts by mass
- platinum catalyst 0.1 parts by mass The metal mold was then heated to 150° C. for 15 minutes to cure the silicone rubber through vulcanization. The mandrel having a cured silicone rubber layer on the circumferential surface was removed from the metal mold, and was further heated at 180° C. for one hour to complete the curing reaction of the silicone rubber layer. Elastic roller D-1 including the mandrel and the silicone rubber elastic layer having a diameter of 12 mm formed on the outer periphery thereof was prepared.

(Preparation of Elastic Roller D-2)

The surface of a rod made of free cutting steel and having a length of 252 mm and an outer diameter of 6 mm was plated with nickel by electroless plating. Next, an adhesive was applied over the rod excluding portions ranging 11 mm from both ends of the rod (the length of the applied area: 230 mm) to prepare a mandrel. An electro-conductive hot-melt adhesive was used. The adhesive was applied with a roll coater.

Next, the following materials were mixed in the following amounts with a pressurizing kneader to prepare Kneaded rubber composition A.

- NBR rubber (trade name: Nipol DN219; available from ZEON Corporation) 100.0 parts by mass
- carbon black (trade name: TOKABLACK #4300; available from Tokai Carbon Co., Ltd.) 40.0 parts by mass
- calcium carbonate (trade name: NANOX #30; available from Maruo Calcium Co., Ltd.) 20.0 parts by mass
- stearic acid (trade name: Stearic Acid S; available from Kao Corporation) 1.0 part by mass Furthermore, Kneaded rubber composition A (166.0 parts by mass) was mixed with the following materials in amounts listed below with an open roll mill to prepare an unvulcanized rubber composition.

- sulfur (trade name: Sulfax 200S; available from TSURUMI CHEMICAL INDUSTRY CO., LTD.) 1.2 parts by mass
- tetrabenzylthiuram disulfide (trade name: TBZTD; available from Sanshin Chemical Industry Co., Ltd.) 4.5 parts by mass Next, a die having an inner diameter of 16.5 mm was attached to a crosshead extruder having a mechanism to feed a mandrel and a mechanism to discharge an unvulcanized rubber roller. The temperatures of the extruder and the die (crosshead) were adjusted to 80° C. and the conveying rate of the electro-conductive mandrel was adjusted to 60 mm/sec. Under this condition, the unvulcanized rubber composition was fed from the extruder to apply the unvulcanized rubber composition onto the electro-conductive mandrel in the crosshead to form an elastic layer. Next, the mandrel was placed in a hot air vulcanizing furnace at 170° C., and was heated for 60 minutes. After cooling, the ends of the elastic layer were removed by cutting, and the surface of the elastic layer was polished with a rotary grinding wheel to prepare Elastic roller D-2 having a diameter of 8.4 mm in a portion located 90 mm from the center of the axis toward each end and a central diameter of 8.5 mm.

(Preparation of Surface Layer)

Synthetic Example for preparing a surface layer used in the present invention will now be described.

<Synthesis of Ion Conducting Agent>

The ion conducting agent used in the present invention can be prepared, for example, by preparing a precursor through one or more stages of known nucleophilic substitution reaction such as a Menschutkin reaction, and performing a known ion exchange reaction.

Examples of usable nucleophiles include nucleophilic compounds having a nitrogen atom such as imidazole compounds, pyridine compounds, pyrazole compounds, oxazole compounds, thiazole compounds, benzimidazole compounds, and quinoline compounds.

Examples of usable electrophiles include halogenated alkyl compounds in which a hydroxyl group is substituted.

Examples of alkali metal salts usable in the ion exchange reaction include alkali metal salts containing the anion of the present invention described above, such as lithium fluoroalkylsulfonate and fluoroalkylsulfonylimide potassium salts.

A desired combination of the nucleophiles and the electrophiles used in the nucleophilic substitution reaction and the alkali metal salts used in the ion exchange reaction can attain a target ion conducting agent by a combination of known methods. Examples of synthesis of the ion conducting agent will now be described. The nucleophiles and the electrophiles and the alkali metal salts used in the ion exchange reaction are shown in Tables 1, 2, and 9.

(Synthesis of Ion Conducting Agent Precursor P-1)

A stirrer and tetrahydrofuran (hereinafter referred to as THF, available from KANTO CHEMICAL CO., INC.) (50 ml) were placed in an eggplant-shaped flask equipped with a Dimroth condenser. Sodium hydride (available from KANTO CHEMICAL CO., INC.) (12.5 g, 0.52 mol) was dispersed, and the eggplant-shaped flask was cooled in an ice bath. Nucleophile N-1 (imidazole, available from Tokyo Chemical Industry Co., Ltd.) (8.94 g, 0.13 mol) was dissolved in THF (50 ml) to prepare a solution, and the solution was slowly added dropwise. The ice bath was removed, and the solution was stirred at room temperature for two hours. Electrophile Q-1 (2-bromoethanol, available from Tokyo Chemical Industry Co., Ltd.) (41.1 g, 0.33 mmol) was added at room temperature, and the solution was refluxed under heating at 70° C. for seven hours. After the reaction, the reaction solution was filtered, and the insoluble content was washed off with THF. The solvent in the filtrate was distilled off under reduced pressure. The product was redissolved in dichloromethane, and the solution was filtered. After the filtrate was recovered, the solvent was distilled off under reduced pressure. The condensed product was washed with diethyl ether, and was dried under reduced pressure to prepare Ion conducting agent precursor P-1 (28 g).

TABLE 1

| Nucleophile | |
|---|---|
| Imidazole (available from Tokyo Chemical Industry Co., Ltd.) | N-1 |
| 2-Ethylimidazole (available from Tokyo Chemical Industry Co., Ltd.) | N-2 |
| 2-Methylbenzimidazole (available from Tokyo Chemical Industry Co., Ltd.) | N-3 |
| 2-Pyridineethanol (available from Tokyo Chemical Industry Co., Ltd.) | N-4 |
| 5-Ethyl-2-pyridineethanol (available from Tokyo Chemical Industry Co., Ltd.) | N-5 |
| 6-Methyl-2-pyridinemethanol (available from Tokyo Chemical Industry Co., Ltd.) | N-6 |
| 3-Bromopyridine (available from Tokyo Chemical Industry Co., Ltd.) | N-7 |
| Pyrazole (available from Tokyo Chemical Industry Co., Ltd.) | N-8 |
| 3-Bromoquinoline (available from Tokyo Chemical Industry Co., Ltd.) | N-9 |
| 2-Bromothiazole (available from Tokyo Chemical Industry Co., Ltd.) | N-10 |
| 5-Bromo-4-methyl-2-phenyl-1,3-oxazole (available from KANTO CHEMICAL CO., INC.) | N-11 |
| Dibutylamine (available from Tokyo Chemical Industry Co., Ltd.) | N-12 |
| Piperidine (available from Tokyo Chemical Industry Co., Ltd.) | N-13 |
| Pyrrolidine (available from Tokyo Chemical Industry Co., Ltd.) | N-14 |
| Morpholine (available from Tokyo Chemical Industry Co., Ltd.) | N-15 |
| 4,5-Dibromoimidazole (available from available from Sigma Aldrich) | N-16 |
| 3,5-Dibromopyridine (available from Tokyo Chemical Industry Co., Ltd.) | N-17 |

TABLE 2

| Electrophile | |
|---|---|
| 2-Bromoethanol (available from Tokyo Chemical Industry Co., Ltd.) | Q-1 |
| 2-[2-(2-Chloroethoxy)ethoxy]ethanol (available from Tokyo Chemical Industry Co., Ltd.) | Q-2 |
| 6-Bromo-1-hexanol (available from Tokyo Chemical Industry Co., Ltd.) | Q-3 |
| 4-Bromo-1-butanol (available from Tokyo Chemical Industry Co., Ltd.) | Q-4 |
| 8-Bromo-1-octanol (available from Tokyo Chemical Industry Co., Ltd.) | Q-5 |
| 10-Bromo-1-decanol (available from Tokyo Chemical Industry Co., Ltd.) | Q-6 |
| 11-Bromo-1-undecanol (available from Tokyo Chemical Industry Co., Ltd.) | Q-7 |

TABLE 2-continued

| Electrophile | |
|---|---|
| 12-Bromo-1-dodecanol (available from Tokyo Chemical Industry Co., Ltd.) | Q-8 |
| 2-Bromoethoxy-tert-butyldimethylsilane (available from Sigma Aldrich) | Q-9 |
| 6-Bromohexyloxy-tert-butyldimethylsilane (available from Sigma Aldrich) | Q-10 |
| Iodoethane (available from Tokyo Chemical Industry Co., Ltd.) | Q-11 |
| 1-Bromoethane (available from Tokyo Chemical Industry Co., Ltd.) | Q-12 |

(Synthesis of Ion Conducting Agent Precursors P-2, P-7, and P-16)

Ion conducting agent precursors P-2, P-7, and P-16 were prepared in the same manner as in Synthesis of Ion conducting agent precursor P-1 except that the types and compounding amounts of the nucleophile and the electrophile as raw materials were varied as shown in Table 3.

TABLE 3

| Ion conducting agent precursor | Nucleophile | Nucleophile (g) | Electrophile | Electrophile (g) |
|---|---|---|---|---|
| P-2 | N-2 | 11.8 | Q-1 | 38.2 |
| P-7 | N-1 | 6.5 | Q-3 | 43.5 |
| P-16 | N-8 | 8.9 | Q-1 | 41.1 |

(Synthesis of Ion Conducting Agent Precursor P-3)

Nucleophile N-1 (imidazole, available from Tokyo Chemical Industry Co., Ltd.) (6.17 g, 0.09 mol), Electrophile Q-2 (2-[2-(2-chloroethoxyl)ethoxy]ethanol, available from Tokyo Chemical Industry Co., Ltd.) (23 g, 0.14 mol), potassium carbonate (available from KANTO CHEMICAL CO., INC.) (25 g, 0.18 mol), and acetone (200 ml) were placed in a flask equipped with a Dimroth condenser, and the solution was refluxed under heating at 65° C. overnight. After the reaction, the reaction solution was filtered, and the solvent in the filtrate was distilled off under reduced pressure. The product was refined by silica gel column chromatography (ethyl acetate) to prepare a compound containing the tertiarized nucleophile. The compound was then dissolved in dichloromethane (50 ml), and Electrophile Q-4 (4-bromo-1-butanol, available from Tokyo Chemical Industry Co., Ltd.) (20.8 g, 0.14 mol) was added. The solution was refluxed under heating at 40° C. for 18 hours. After the reaction, the solvent was distilled off under reduced pressure. The product was washed with diethyl ether, and was dried to prepare quaternarized Ion conducting agent precursor P-3 as white powder.

(Synthesis of Ion Conducting Agent Precursors P-4, P-5, and P-6)

Ion conducting agent precursors P-4, P-5, and P-6 were prepared in the same manner as in Synthesis of Ion conducting agent precursor P-3 except that the types and compounding amounts of the nucleophile and the electrophile as raw materials were varied as shown in Table 4.

TABLE 4

| Ion conducting agent precursor | Nucleophile | Nucleophile (g) | Electrophile for tertiarization | Electrophile (g) | Electrophile for quaternarization | Electrophile (g) |
|---|---|---|---|---|---|---|
| P-4 | N-1 | 5.2 | Q-3 | 20.8 | Q-5 | 24.0 |
| P-5 | N-1 | 4.6 | Q-5 | 21.3 | Q-6 | 24.1 |
| P-6 | N-1 | 4.0 | Q-7 | 22.4 | Q-8 | 23.6 |

(Synthesis of Ion Conducting Agent Precursor P-8)

Distilled THF (500 ml) and 2,6-di-tert-butylpyridine (available from Sigma Aldrich) (1 g) were placed in a round-bottomed flask, and was cooled to 0° C. under a nitrogen atmosphere. Subsequently, methyl trifluoromethanesulfonate (available from Tokyo Chemical Industry Co., Ltd.) (3.6 g, 22 mmol) was added as an initiator. Nucleophile N-3 (2-methylbenzimidazole, available from Tokyo Chemical Industry Co., Ltd.) (5.87 g, 44.5 mmol) was added to terminate polymerization, and the polymer was precipitated in water and diethyl ether for refining. The polymer was dried under reduced pressure to prepare imidazole substituted by tetramethylene glycol as white powder. To quaternarize this white power, the polymer was dissolved in dichloromethane (200 ml), and Electrophile Q-3 (6-bromo-1-hexanol, available from Tokyo Chemical Industry Co., Ltd.) (12.1 g, 67 mmol) was added. The solution was refluxed under heating at 40° C. for 18 hours. After the reaction, the solvent was distilled off under reduced pressure. The product was washed with diethyl ether, and was dried to prepare white powder. To exchange the anion for chloride ions, the polymer was stirred in methanol having an ion exchange resin Dowex (available from Wako Pure Chemical Industries, Ltd.) dispersed therein for 2 to 3 hours. The ion exchange resin was removed through filtration, and was dried to prepare quaternarized Ion conducting agent precursor P-8. The anion of P-8 was chloride ion.

(Synthesis of Ion Conducting Agent Precursor P-9)

Ion conducting agent precursor P-9 was prepared in the same manner as in Ion conducting agent precursor P-8 except that Nucleophile N-1 (imidazole, available from Tokyo Chemical Industry Co., Ltd.) (2.87 g, 42 mmol), Electrophile Q-8 (12-bromo-1-dodecanol, available from Tokyo Chemical Industry Co., Ltd.) (16.8 g, 63 mmol) were used in the reaction.

(Synthesis of Ion Conducting Agent Precursor P-10)

Nucleophile N-4 (2-pyridine ethanol, available from Tokyo Chemical Industry Co., Ltd.) (12.0 g, 0.15 mol) was dissolved in dichloromethane (200 ml), and Electrophile Q-1 (2-bromoethanol, available from Tokyo Chemical Industry Co., Ltd.) (38 g, 0.3 mol) was added. The solution was refluxed under heating at 40° C. for 18 hours. After the reaction, the solvent was distilled off under reduced pressure. The product was washed with diethyl ether to prepare quaternarized Ion conducting agent precursor P-10 as white powder.

(Synthesis of Ion Conducting Agent Precursors P-11, P-12, P-14)

Ion conducting agent precursors P-11, P-12, and P-14 were prepared in the same manner as in Ion conducting agent precursor P-10 except that the types and compounding amounts of the nucleophile and the electrophile as raw materials used in the reaction were varied as shown in Table 5.

TABLE 5

| Ion conducting agent precursor | Nucleophile | Nucleophile (g) | Electrophile | Electrophile (g) |
|---|---|---|---|---|
| P-11 | N-5 | 15.4 | Q-2 | 34.6 |
| P-12 | N-6 | 12.8 | Q-3 | 37.2 |
| P-14 | N-5 | 10.3 | Q-6 | 39.7 |

(Synthesis of Ion Conducting Agent Precursor P-13)

Distilled THF (500 ml) and 2,6-di-tert-butyl pyridine (available from Sigma Aldrich) (1.2 g) were placed in a round-bottomed flask, and were cooled to 0° C. under an inert atmosphere. Subsequently, methyl trifluoromethane sulfonate (4.92 g, 30 mmol) was added as an initiator. Nucleophile N-4 (2-pyridineethanol, available from Tokyo Chemical Industry Co., Ltd.) (7.3 g, 59 mmol) was added to terminate polymerization. The polymer was precipitated in water and diethyl ether for refining, and was dried under reduced pressure to prepare a pyridinium salt substituted by tetramethylene glycol as white powder. To exchange the anion for chloride ion, the polymer was stirred in methanol having an ion exchange resin Dowex (available from Wako Pure Chemical Industries, Ltd.) dispersed therein for 2 to hours. The ion exchange resin was removed through filtration, and was dried to prepare quaternarized Ion conducting agent precursor P-13. The anion of P-13 was chloride ion.

(Synthesis of Ion Conducting Agent Precursor P-15)

tert-Butyldimethylsilyl chloride was reacted with Electrophile Q-6 (10-bromo-1-decanol, available from Tokyo Chemical Industry Co., Ltd.) (19 g, 80 mmol) in N,N-dimethylformamide in the presence of imidazole at room temperature for three hours. The product was separated in ethyl acetate/water, and was dried to prepare a compound in which a hydroxyl group was substituted by a silyl group. Nucleophile N-7 (3-bromopyridine, available from Tokyo Chemical Industry Co., Ltd.) (8.55 g, 54 mmol) was dissolved in distilled THF (400 ml) under an inert atmosphere, and the solution was cooled to −78° C. in a dry ice/methanol bath. Subsequently, a solution of 2.6 mol/l n-butyllithium/hexane (available from KANTO CHEMICAL CO., INC.) (23 ml, 60 mmol) was slowly added dropwise, and was stirred for 30 minutes. Subsequently, a solution (50 ml) of silylated Q-6 in THF was slowly added dropwise. After the solution was reacted at −78° C. for three hours and at room temperature overnight, hydrochloric acid was added to the reaction solution, and was stirred at room temperature for one hour for desilylation. After the solvent was distilled off under reduced pressure, the product was separated with dichloromethane/water, and was dried to prepare 3-(10-hydroxydecyl)pyridine as white powder. This powder was dissolved in dichloromethane (50 ml), and Electrophile Q-8 (12-bromo-1-dodecanol, available from Tokyo Chemical Industry Co., Ltd.) (15.8 g, 60 mmol) was added for quaternerization. The solution was refluxed under heating at 40° C. for 18 hours. After the reaction, the solvent was distilled off under reduced pressure. The product was washed with diethyl ether, and was dried to prepare quartenarized Ion conducting agent precursor P-15 as white powder. The anion of P-15 was bromide ion.

(Synthesis of Ion Conducting Agent Precursors P-17, P-18, and P-19)

Ion conducting agent precursors P-17, P-18, and P-19 were prepared in the same manner as in Ion conducting agent precursor P-15 except that the nucleophile and electrophile used in the reaction were varied as shown in Table 6.

TABLE 6

| Ion conducting agent precursor | Nucleophile | Nucleophile (g) | Electrophile for silylation | Electrophile (g) | Electrophile for quaternarization | Electrophile (g) |
|---|---|---|---|---|---|---|
| P-17 | N-9 | 13.5 | Q-3 | 12.9 | Q-3 | 23.5 |
| P-18 | N-10 | 13.4 | Q-3 | 16.2 | Q-1 | 20.4 |
| P-19 | N-11 | 19.1 | Q-1 | 11.0 | Q-1 | 19.9 |

(Synthesis of Ion Conducting Agent Precursor P-20)

A Dimroth condenser was attached to an eggplant-shaped flask. Nucleophile N-12 (dibutylamine, available from Tokyo Chemical Industry Co., Ltd.) (14.5 g, 0.11 mol) and Electrophile Q-1 (2-bromoethanol, available from Tokyo Chemical Industry Co., Ltd.) (35.5 g, 0.28 mol) were dissolved in acetonitrile (200 ml), and potassium carbonate (69 g, 0.5 mol) was added. The solution was refluxed at a boiling point of 90° C. overnight. The reaction solution was separated with ethyl acetate/water to recover an organic layer. The solvent was distilled off under reduced pressure to prepare quartenarized Ion conducting agent precursor P-20 as white solid. The anion of the precursor was bromide ion.

(Synthesis of Ion Conducting Agent Precursors P-21, P-22, and P-23)

Ion conducting agent precursors P-21, P-22, and P-23 were prepared in the same manner as in Ion conducting agent precursor P-20 except that the nucleophile and the electrophile used in the reaction were varied as shown in Table 7.

TABLE 7

| Ion conducting agent precursor | Nucleophile | Nucleophile (g) | Electrophile | Electrophile (g) |
|---|---|---|---|---|
| P-21 | N-13 | 10.7 | Q-1 | 39.3 |
| P-22 | N-14 | 9.3 | Q-1 | 40.7 |
| P-23 | N-15 | 10.9 | Q-1 | 39.1 |

(Synthesis of Ion Conducting Agent Precursor P-24)

Nucleophile N-16 (4,5-dibromoimidazole, available from Sigma Aldrich) (15.5 g, 73 mmol), Electrophile Q-12 (1-bromobutane, available from Tokyo Chemical Industry Co., Ltd.) (15.2 g, 0.11 mol), potassium carbonate (available from KANTO CHEMICAL CO., INC.) (27.8 g, 0.2 mol), and acetone (100 ml) were added, and were refluxed under heating at 65° C. overnight. After the reaction, the reaction solution was filtered. The solvent in the filtrate was distilled off under reduced pressure, and the product was refined by silica gel column chromatography (ethyl acetate) to prepare a compound having a tertiarized nucleophile. Subsequently, the compound was dissolved in dichloromethane (50 ml). Electrophile Q-11 (iodoethane, available from Tokyo Chemical Industry Co., Ltd.) (17.1 g, 0.11 mmol) was added, and the solution was refluxed under heating at 40° C. for 18 hours. After the reaction, the solvent was distilled off under reduced pressure. The product was washed with diethyl ether to prepare 4,5-dibromoethylbutylimidazolium iodide as white powder. Subsequently, the compound was dissolved in distilled THF (300 ml) under a nitrogen atmosphere, and the solution was cooled to −78° C. in a dry ice/methanol bath. Subsequently, 2.6M solution of n-butyllithium/hexane (available from KANTO CHEMICAL CO., INC.) (80 ml) was slowly added dropwise, and was stirred for 30 minutes. Subsequently, a solution (100 ml) of Nucleophile Q-9 (2-bromoethoxy-tert-butyldimethylsilane, available from Sigma Aldrich) (52.3 g, 0.22 mmol) in THF was slowly added dropwise. After the solution was reacted at −78° C. for three hours and at room temperature overnight, hydrochloric acid was added to the reaction solution, and was stirred at room temperature for one hour for desilylation. After the solvent was distilled off under reduced pressure, the product was separated with ethyl acetate/water to prepare Ion conducting agent precursor P-24 as white powder. The anion of P-24 was iodide ion.

(Synthesis of Ion Conducting Agent Precursors P-25, P-26, P-27, and P-28)

Ion conducting agent precursors P-25, P-26, P-27, and P-28 were prepared in the same manner as in Ion conducting agent precursor P-24 except that the nucleophile and the electrophile used in the reaction were varied as shown in Table 8. Q-12 in Synthesis of Ion conducting agent precursor P-24 represents Electrophile A, Q-11 Electrophile B, and Q-9 Electrophile C.

TABLE 8

| Ion conducting agent precursor | Nucleophile | Nucleophile (g) | Electrophile A | Electrophile A (g) | Electrophile B | Electrophile B (g) | Electrophile C | Electrophile C (g) |
|---|---|---|---|---|---|---|---|---|
| P-25 | N-1 | 22.0 | Q-12 | 19.4 | Q-1 | 17.4 | Q-10 | 41.1 |
| P-26 | N-16 | 13.8 | Q-12 | 13.5 | Q-11 | 15.2 | Q-10 | 57.5 |
| P-27 | N-17 | 17.0 | Q-12 | 14.9 | Q-11 | 16.8 | Q-9 | 51.3 |
| P-28 | N-17 | 15.1 | Q-12 | 13.3 | Q-11 | 15.0 | Q-10 | 56.6 |

The anions of Ion conducting agent precursors P-1 to P-28 prepared by the methods above are halide ions such as chloride ion and bromide ion. To exchange these anions for target anions, target ion conducting agents were prepared by the following ion exchange reaction. The anion exchange salts used are listed in Table 9.

(Synthesis of Ion Conducting Agent C-1)

Ion conducting agent precursor P-1 (7.7 g, 33 mmol) was dissolved in dichloromethane (50 ml). An aqueous solution of Anion exchange salt A-1 (bis(trifluoromethane sulfone) imidelithium, available from Tokyo Chemical Industry Co., Ltd.) (10.3 g, 36 mmol) was added, and was stirred for 24 hours. The solution was separated to yield an organic layer. The organic layer was separated with water twice, and dichloromethane was distilled off under reduced pressure to prepare Ion conducting agent C-1 having bis(trifluoromethanesulfone)imide anion.

TABLE 9

| Anion exchange salt | |
|---|---|
| Lithium bis(trifluoromethanesulfone)imide (available from Tokyo Chemical Industry Co., Ltd.) | A-1 |
| Lithium perchlorate (available from KANTO CHEMICAL CO., INC.) | A-2 |
| Lithium bis(oxalato)borate (from available Sigma Aldrich) | A-3 |
| Lithium trifluoromethanesulfonate (available from Tokyo Chemical Industry Co., Ltd.) | A-4 |
| Potassium N,N-bis(fluorosulfonyl)imide (available from Mitsubishi Materials Electronic Chemicals Co., Ltd.) | A-5 |
| Bis(nonafluorobutanesulfonyl)imide potassium salt (trade name EF-N442, available from Mitsubishi Materials Electronic Chemicals Co., Ltd.) | A-6 |
| Sodium dicyanamide (available from Tokyo Chemical Industry Co., Ltd.) | A-7 |
| Potassium tris(trifluoromethanesulfonyl)methide (trade name K-TFSM, available from Mitsubishi Materials Electronic Chemicals Co., Ltd.) | A-8 |
| Potassium hexafluoroarsenate (available from Tokyo Chemical Industry Co., Ltd.) | A-9 |
| Lithium acetate (available from Tokyo Chemical Industry Co., Ltd.) | A-10 |
| Lithium trifluoroacetate (available from Wako Pure Chemical Industries, Ltd.) | A-11 |
| Potassium heptafluoropropanesulfonate (trade name EF-32, available from Mitsubishi Materials Electronic Chemicals Co., Ltd.) | A-12 |
| Potassium cyclo-hexafluoropropane-1,3-bis(sulfonyl)imide (trade name EF-N302, available from Mitsubishi Materials Electronic Chemicals Co., Ltd.) | A-13 |
| Potassium trifluoro(trifluoromethyl)borate (available from Tokyo Chemical Industry Co., Ltd.) | A-14 |
| Lithium hexafluorophosphate (available from Wako Pure Chemical Industries, Ltd.) | A-15 |
| Lithium hexafluoroantimonate (available from Wako Pure Chemical Industries, Ltd.) | A-16 |

(Synthesis of Ion Conducting Agents C-2 to C-11, C-13 to C-30)

Ion conducting agents C-2 to C-11 and C-13 to C-30 were prepared in the same manner as in Ion conducting agent C-1 except that the types and the compounding amounts of the ion conducting agent precursor and the Anion exchange salt used in the reaction were varied as shown in Table 10. For Ion conducting agent C-12, Ion conducting agent precursor P-11 was used as it was without performing ion exchange.

TABLE 10

| Ion conducting agent | Ion conducting agent precursor | Ion conducting agent precursor (g) | Anion exchange salt | Anion exchange salt (g) |
|---|---|---|---|---|
| C-1 | P-1 | 7.7 | A-1 | 10.3 |
| C-2 | P-2 | 8.2 | A-1 | 9.8 |
| C-3 | P-1 | 12.1 | A-2 | 5.9 |
| C-4 | P-3 | 11.2 | A-3 | 6.8 |
| C-5 | P-4 | 12.4 | A-4 | 5.6 |
| C-6 | P-5 | 13.3 | A-5 | 4.7 |
| C-7 | P-6 | 11.1 | A-1 | 6.9 |
| C-8 | P-7 | 6.1 | A-6 | 11.9 |
| C-9 | P-8 | 14.8 | A-7 | 3.2 |
| C-10 | P-9 | 10.0 | A-8 | 8.0 |
| C-11 | P-10 | 7.9 | A-1 | 10.1 |
| C-13 | P-12 | 9.9 | A-9 | 8.1 |
| C-14 | P-13 | 14.5 | A-10 | 3.5 |
| C-15 | P-14 | 13.4 | A-11 | 4.6 |
| C-16 | P-15 | 11.0 | A-12 | 7.0 |
| C-17 | P-13 | 9.9 | A-13 | 8.1 |
| C-18 | P-16 | 7.7 | A-1 | 10.3 |
| C-19 | P-17 | 10.5 | A-14 | 7.5 |
| C-20 | P-18 | 11.7 | A-15 | 6.3 |
| C-21 | P-19 | 9.3 | A-16 | 8.7 |
| C-22 | P-20 | 7.3 | A-1 | 10.7 |
| C-23 | P-21 | 9.1 | A-9 | 8.9 |
| C-24 | P-22 | 9.5 | A-3 | 8.5 |
| C-25 | P-23 | 10.8 | A-4 | 7.2 |
| C-26 | P-24 | 11.0 | A-5 | 7.0 |
| C-27 | P-25 | 5.4 | A-6 | 12.6 |
| C-28 | P-26 | 9.5 | A-1 | 8.5 |
| C-29 | P-27 | 12.9 | A-7 | 5.1 |
| C-30 | P-28 | 12.7 | A-5 | 5.3 |

The structures of Ion conducting agents C-1 to C-8, C-10 and C-26 to C-28 are represented by Structural Formula (3) and shown in Table 11, the structures of Ion conducting agents C-11 to C-17, C-29, and C-30 are represented by Structural Formula (4) and shown in Table 12, and the structures of Ion conducting agents C-9 and C-18 to C-25 are represented by Structural Formulae (5) to (13).

Structural Formula (3)

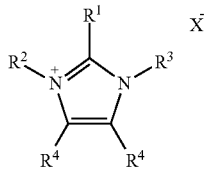

TABLE 11

| Ion conducting agent | Structure | $R_1$ | $R_2$ | $R_3$ | $R_4$ | Anion ($X^-$) |
|---|---|---|---|---|---|---|
| C-1 | Structural Formula (3) | H | $C_2H_4OH$ | $C_2H_4OH$ | H | $(CF_3SO_2)_2N^-$ |
| C-2 | | $C_2H_5$ | $C_2H_4OH$ | $C_2H_4OH$ | H | $(CF_3SO_2)_2N^-$ |
| C-3 | | H | $C_2H_4OH$ | $C_2H_4OH$ | H | $ClO_4^-$ |
| C-4 | | H | $C_4H_8OH$ | $(C_2H_4O)_3H$ | H | $(C_2O_4)_2B^-$ |

TABLE 11-continued

| Ion conducting agent | Structure | $R_1$ | $R_2$ | $R_3$ | $R_4$ | Anion ($X^-$) |
|---|---|---|---|---|---|---|
| C-5 | | H | $C_6H_{12}OH$ | $C_8H_{16}OH$ | H | $CF_3SO_3^-$ |
| C-6 | | H | $C_8H_{16}OH$ | $C_{10}H_{20}OH$ | H | $(FSO_2)_2N^-$ |
| C-7 | | H | $C_{11}H_{22}OH$ | $C_{12}H_{24}OH$ | H | $(CF_3SO_2)_2N^-$ |
| C-8 | | H | $C_6H_{12}OH$ | $C_6H_{12}OH$ | H | $(C_4F_9SO_2)_2N^-$ |
| C-10 | | H | $(C_4H_8O)_4H$ | $C_{12}H_{24}OH$ | H | $(CF_3SO_2)_3C^-$ |
| C-26 | | H | $C_2H_5$ | $C_4H_9$ | $C_2H_4OH$ | $(FSO_2)_2N^-$ |
| C-27 | | $C_2H_4OH$ | $C_6H_{12}OH$ | $C_4H_9$ | H | $(C_4F_9SO_2)_2N^-$ |
| C-28 | | H | $C_2H_5$ | $C_4H_9$ | $C_6H_{12}OH$ | $(CF_3SO_2)_2N^-$ |

Structural Formula (4)

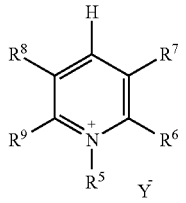

TABLE 12

| Ion conducting agent | Structure | $R_5$ | $R_6$ | $R_7$ | $R_8$ | $R_9$ | Anion ($Y^-$) |
|---|---|---|---|---|---|---|---|
| C-11 | Structural Formula (4) | $C_2H_4OH$ | $C_2H_4OH$ | H | H | H | $(CF_3SO_2)_2N^-$ |
| C-12 | | $(C_2H_4O)_3H$ | $C_2H_4OH$ | H | $C_2H_5$ | H | $Cl^-$ |
| C-13 | | $C_6H_{12}OH$ | $CH_2OH$ | H | H | $CH_3$ | $AsF_6^-$ |
| C-14 | | $(C_4H_8O)_2H$ | $C_2H_4OH$ | H | H | H | $CH_3COO^-$ |
| C-15 | | $C_{10}H_{20}OH$ | $C_2H_4OH$ | H | $C_2H_5$ | H | $CF_3COO^-$ |
| C-16 | | $C_{12}H_{24}OH$ | H | $C_{10}H_{20}OH$ | H | H | $C_3F_7SO_3^-$ |
| C-17 | | $(C_4H_8O)_4H$ | $C_2H_4OH$ | H | H | H | $CF_2(CF_2SO_2)_2N^-$ |
| C-29 | | H | H | $C_2H_4OH$ | $C_2H_4OH$ | H | $N(CN)_2^-$ |
| C-30 | | H | H | $C_6H_{12}OH$ | $C_6H_{12}OH$ | H | $(FSO_2)_2N^-$ |

Ion conducting agent C-9

Structural Formula (5)

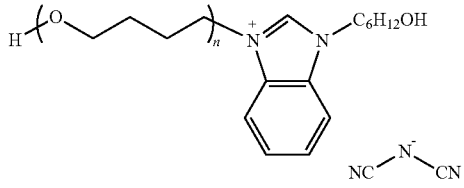

In the Structural Formula (5), n is 2.

Ion conducting agent C-18

Structural Formula (6)

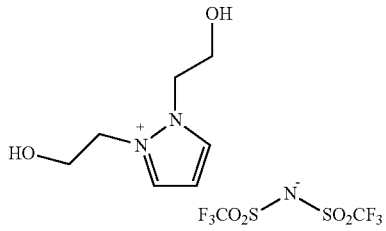

-continued

Ion conducting agent C-19

Structural Formula (7)

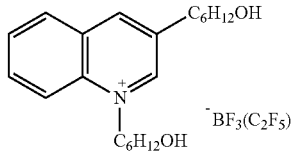

-continued

Ion conducting agent C-20

Structural Formula (8)

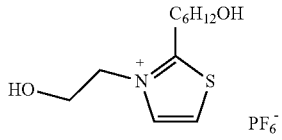

Ion conducting agent C-21

Structural Formula (9)

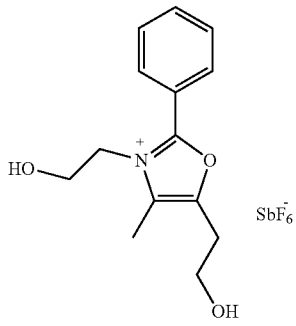

-continued

Ion conducting agent C-22

Structural Formula (10)

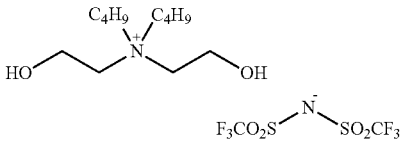

Ion conducting agent C-23

Structural Formula (11)

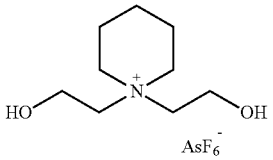

Ion conducting agent C-24

Structural Formula (12)

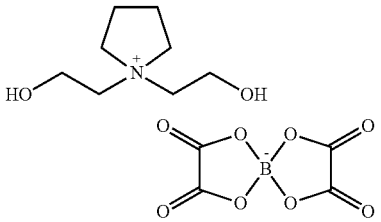

Ion conducting agent C-25

Structural Formula (13)

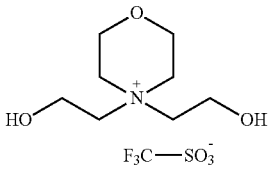

ethyl ketone (MEK) (50 parts by mass) to prepare a solution of Isocyanate group-terminated prepolymer B-1 (isocyanate group content: 3.4%).

(Synthesis of Isocyanate Group-terminated Prepolymers B-2 to B-4)

Isocyanate group-terminated prepolymers B-2 to B-4 were prepared in the same manner as in Isocyanate group-terminated prepolymer B-1 except that the types and the compounding amounts of isocyanate and polyol used in the reaction were varied as shown in Tables 13 to 15.

TABLE 13

| Isocyanate | |
|---|---|
| Polymeric MDI (trade name: Millionate MR200, available from Tosoh Corporation (the former Nippon Polyurethane Industry Co., Ltd.)) | D-1 |
| Tolylene diisocyanate (TDI) (trade name: COSMONATE T80, available from Mitsui Chemicals, Inc.) | D-2 |

TABLE 14

| Polyol | |
|---|---|
| Poly(tetramethylene glycol) (trade name: PTMG2000, available from Mitsubishi Chemical Corporation) | F-1 |
| Polyethylene glycol (trade name: PEG-2000, available from Sanyo Chemical Industries, Ltd.) | F-2 |
| Polybutylene adipate polyol (trade name: NIPPOLAN 4010, available from Tosoh Corporation (the former Nippon Polyurethane Industry Co., Ltd.)) | F-3 |
| Polypropylene glycol polyol (trade name: Sannix PP-1000, available from Sanyo Chemical Industries, Ltd.) | F-4 |

TABLE 15

| Isocyanate-terminated prepolymer | Isocyanate | Amount of isocyanate to be added (parts by mass) | Polyol | Amount of polyol to be added (parts by mass) | Amount of methyl ethyl ketone to be added (parts by mass) | Isocyanate content (%) |
|---|---|---|---|---|---|---|
| B-1 | D-1 | 38 | F-1 | 100 | 50 | 3.4 |
| B-2 | D-1 | 31 | F-2 | 100 | 50 | 2.9 |
| B-3 | D-2 | 24 | F-3 | 100 | 50 | 3.3 |
| B-4 | D-2 | 35 | F-4 | 100 | 50 | 4.5 |

(Synthesis of Isocyanate Group-terminated Prepolymer B-1)

Under a nitrogen atmosphere, Polyol F-1 (poly(tetramethylene glycol) (trade name: PTMG2000; available from Mitsubishi Chemical Corporation)) (100 parts by mass) was gradually added dropwise to Isocyanate D-1 polymeric MDI (trade name: Millionate MR200; available from Tosoh Corporation (the former Nippon Polyurethane Industry Co., Ltd.)) (38 parts by mass) in a reaction container while the inner temperature of the reaction container was kept at 65° C. After the dropping was completed, the reaction was performed at 65° C. for two hours. The reaction mixture was cooled to room temperature, and was diluted with methyl Example 1

The method of producing the electrophotographic member according to the present invention will now be described.

The following materials were mixed by stirring to prepare a material for a surface layer.

reactive compound

Isocyanate group-terminated prepolymer B-1 66.4 parts by mass polyol

Polyol E-1 (poly(tetramethylene glycol) (available from Mitsubishi Chemical Corporation)) 30.6 parts by mass ion conducting agent Ion conducting agent C-1 3.0 parts by mass urethane resin fine particles (trade name, Art-pearl C-400; available from Negami Chemical Industrial Co., Ltd.) 90.0 parts by mass Next, methyl ethyl ketone (hereinafter, referred to as MEK) was added to the mixture such that the total solid content was 30% by mass, and was mixed with a sand mill. The viscosity of the mixture was adjusted with MEK to 10 to 13 cps to prepare a coating material for forming a surface layer.

Elastic roller D-1 prepared above was immersed in the coating material for forming a surface layer to form a coating of the coating material on the surface of the elastic layer of Elastic roller D-1. The coating was dried. The coating was further heated at 160° C. for one hour to form a surface layer having a thickness of 15 μm on the outer periphery of the elastic layer. An electrophotographic member in Example 1 was prepared.

The structure represented by Structural Formula 1 contained in the resin in the surface layer can be confirmed by pyrolysis GC/MS, evolved gas analysis (EGA-MS), or FT-IR or NMR analysis, for example.

The surface layer of Example 1 was analyzed with a pyrolysis apparatus (trade name: Pyrofoil Sampler JPS-700, available from Japan Analytical Industry Co., Ltd.) and a GC/MS apparatus (trade name: Focus GC/ISQ, available from Thermo Fisher Scientific Inc.) at a pyrolysis temperature of 590° C. using helium as a carrier gas. From the fragment peaks obtained, it was confirmed that the resin included in the surface layer had a structure represented by Structural Formula (1).

The electrophotographic member thus prepared in Example 1 was evaluated as developing roller (developer carrying member) for the following items.

[Measurement of Current Value of Developing Roller]

A developing roller was left to stand under an environment at 23° C. and 45% RH (hereinafter, referred to as N/N) for 6 hours or longer, and the current value of the developing roller was measured under the N/N environment.

Figure 4A:
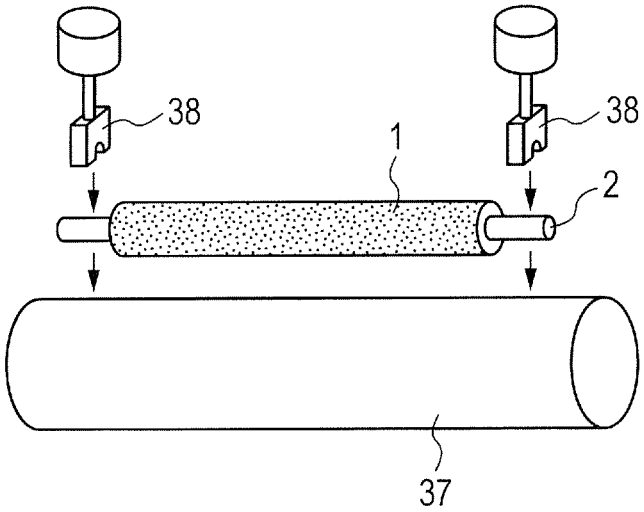
FIG. 4A is a schematic view illustrating a configuration of a measurement apparatus for measuring the current value of the electrophotographic member according to the present invention, in which the electrophotographic member rotates following the other roller.
Figure 4B:
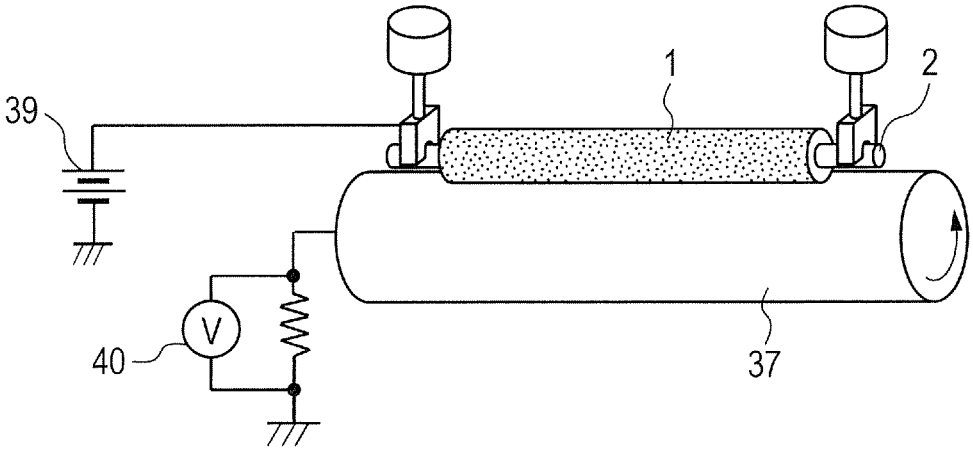
FIG. 4B is a schematic view illustrating a configuration of a measurement apparatus for measuring the current value of the electrophotographic member according to the present invention.

FIGS. 4A and 4B illustrate a schematic configuration of a jig used in evaluation of the current value of the developing roller. An electro-conductive layer having higher electro-conductivity (lower resistance) results in a greater current value which flows in the developing roller. For this reason, the electro-conductivity of the electro-conductive layer can be evaluated by measuring the current value flowing in the developing roller during application of a constant voltage.

First, in FIG. 4A, while a load of 4.9 N was being applied to both ends of the electro-conductive mandrel 2 of the electrophotographic member 1 through electro-conductive bearings 38, a cylindrical metal 37 having a diameter of 40 mm was rotated and the electrophotographic member 1 as a developing roller was rotated at 60 rpm following the rotation of the cylindrical metal 37.

Next, in FIG. 4B, a voltage of 50 V was applied by a high voltage power supply 39, and the difference in potential between both ends of a resistor disposed between the cylindrical metal 37 and the ground and having a known electric resistance (more than two digits lower than the electric resistance of the developing roller) was determined. The difference in potential was determined with a voltmeter 40 (available from Fluke Corporation, 189 TRUE RMS MULTIMETER). From the difference in potential and the electric resistance of the resistor, the current flowing in the cylindrical metal through the electrophotographic member 1 as a developing roller was calculated. The difference in potential was sampled for 3 seconds after 2 seconds from the application of voltage, and the value calculated from the average of the sampling was defined as the current value of the developing roller.

[Evaluation of Ghost]

Next, the developing roller whose current value had been preliminarily determined as described above was left to stand in an environment at a temperature of 15° C. and a relative humidity of 10% (hereinafter, referred to as L/L) for 6 hours or longer, and was evaluated by the following procedure.

A laser printer (trade name: LBP7700C, available from Canon Inc.) which was an electrophotographic apparatus having a configuration illustrated in FIG. 3 was left to stand in the L/L environment. The electrophotographic members prepared in Examples were attached to the printer as a developing roller to evaluate ghost images.

In the evaluation of ghost images, a black toner was used. A black solid image of 15 mm×15 mm was printed in the leading portion of an A4-size paper, and a halftone image was then printed over the rest of the paper. Next, unevenness of the density in the halftone image portions in the printed paper, which appeared in correspondence with the period of the rotation of the developing roller, was visually evaluated according to the following criteria for evaluation of ghost.

(Criteria on Evaluation of Ghost Under L/L Environment)

A: no ghost is found
B: ghost is very slightly found
C: ghost is slightly found
D: ghost is remarkably found

Example 8

A method of producing another electrophotographic member according to the present invention will now be described.

The following materials were mixed by stirring to prepare a material for a surface layer.

reactive compound

Reactive compound R-2 (bisphenol A diglycidyl ether (available from Tokyo Chemical Industry Co., Ltd.)) 18.0 parts by mass polyol Polyol E-4 (polyethylene glycol (available from Sanyo Chemical Industries, Ltd.)) 72.0 parts by mass ion conducting agent Ion conducting agent C-8 10.0 parts by mass urethane resin fine particles (trade name, Art-pearl C-400; available from Negami Chemical Industrial Co., Ltd.) 90.0 parts by mass Next, methyl ethyl ketone (hereinafter, referred to as MEK) was added to the mixture such that the total solid content was 30% by mass, and was mixed with a sand mill. The viscosity of the mixture was adjusted with MEK to 10 to 13 cps to prepare a coating material for forming a surface layer.

Elastic roller D-1 prepared above was immersed in the coating material for forming a surface layer to form a coating of the coating material on the surface of the elastic layer of Elastic roller D-1. The coating was dried. The coating was further heated at 180° C. for two hours to form a surface layer having a thickness of 15 μm on the outer periphery of the elastic layer. An electrophotographic member in Example 8 was prepared.

Example 9

A method of producing another electrophotographic member according to the present invention will now be described.

The following materials were mixed by stirring to prepare a material for a surface layer.

reactive compound

Reactive compound R-3 (2,4,6-tris[bis(methoxy methyl) amino]-1,3,5-triazine (available from Tokyo Chemical Industry Co., Ltd.)) 15.0 parts by mass polyol Polyol E-4 (polyethylene glycol (available from Sanyo Chemical Industries, Ltd.)) 82.0 parts by mass ion conducting agent Ion conducting agent C-9 3.0 parts by mass urethane resin fine particles (trade name, Art-pearl C-400; available from Negami Chemical Industrial Co., Ltd.) 90.0 parts by mass Next, methyl ethyl ketone (hereinafter, referred to as MEK) was added to the mixture such that the total solid content was 30% by mass, and was mixed with a sand mill. The viscosity of the mixture was adjusted with MEK to 10 to 13 cps to prepare a coating material for forming a surface layer.

Elastic roller D-1 prepared above was immersed in the coating material for forming a surface layer to form a coating of the coating material on the surface of the elastic layer of Elastic roller D-1. The coating was dried. The coating was further heated at 180° C. for 20 minutes to form a surface layer having a thickness of 15 μm on the outer periphery of the elastic layer. An electrophotographic member in Example 9 was prepared.

Examples 2 to 7, 10 to 21

Coating materials for forming a surface layer were prepared in the same manner as in Example 1 except that the materials for a surface layer in Example 1, i.e., the reactive compound, the polyol, and the ion conducting agent were varied as shown in Tables 16 to 18. The same amount of the urethane resin fine particles (trade name, Art-pearl C-400; available from Negami Chemical Industrial Co., Ltd.) as those in Examples 1, 8, and 9) (90.0 parts by mass) was used. The coating materials each were applied to Elastic roller D-1, was dried, and was heated in the same manner as in Example 1 to prepare electrophotographic members in Examples 2 to 7 and 10 to 21.

TABLE 16

| Polyol | |
|---|---|
| Poly(tetramethylene glycol) (trade name: PTMG2000, available from Mitsubishi Chemical Corporation) | E-1 |
| Polypropylene glycol polyol (trade name: Sannix PP-1000, available from Sanyo Chemical Industries, Ltd.) | E-2 |
| Polybutylene adipate polyol (NIPPOLAN 4010, available from Tosoh Corporation (the former Nippon Polyurethane Industry Co., Ltd.)) | E-3 |
| Polyethylene glycol (trade name: PEG-2000, available from Sanyo Chemical Industries, Ltd.) | E-4 |

TABLE 17

| Reactive compound | |
|---|---|
| Polymeric MDI (trade name: Millionate MR200, available from Tosoh Corporation (the former Nippon Polyurethane Industry Co., Ltd.)) | R-1 |
| Bisphenol A diglycidyl ether (available from Tokyo Chemical Industry Co., Ltd.) | R-2 |
| 2,4,6-Tris[bis(methoxymethyl)amino]-1,3,5-triazine (available from Tokyo Chemical Industry Co., Ltd.) | R-3 |

TABLE 18

| Example | Reactive compound | Reactive compound (Parts by mass) | Polyol | Polyol (Parts by mass) | Ion conducting agent | Amount of ion conducting agent to be added (Parts by mass) |
|---|---|---|---|---|---|---|
| 1 | B-1 | 66.4 | E-1 | 30.6 | C-1 | 3.0 |
| 2 | B-1 | 61.0 | E-1 | 38.5 | C-2 | 0.5 |
| 3 | B-1 | 72.5 | E-1 | 24.9 | C-3 | 3.0 |
| 4 | B-2 | 80.4 | E-2 | 16.6 | C-4 | 3.0 |
| 5 | B-3 | 78.3 | E-2 | 18.7 | C-5 | 3.0 |
| 6 | R-1 | 14.4 | E-1 | 82.6 | C-6 | 3.0 |
| 7 | B-1 | 63.3 | E-1 | 33.7 | C-7 | 3.0 |
| 8 | R-2 | 18.0 | E-4 | 72.0 | C-8 | 10.0 |
| 9 | R-3 | 15.0 | E-4 | 82.0 | C-9 | 3.0 |
| 10 | B-1 | 62.0 | E-1 | 35.0 | C-10 | 3.0 |
| 11 | B-1 | 66.2 | E-1 | 30.8 | C-11 | 3.0 |
| 12 | B-1 | 70.4 | E-3 | 27.3 | C-12 | 3.0 |
| 13 | B-1 | 87.9 | Not added | 0.0 | C-13 | 12.2 |
| 14 | B-2 | 73.3 | E-1 | 24.0 | C-14 | 3.0 |
| 15 | B-2 | 64.7 | E-4 | 34.8 | C-15 | 0.5 |
| 16 | B-4 | 55.7 | E-4 | 41.3 | C-16 | 3.0 |
| 17 | B-1 | 71.9 | E-1 | 19.6 | C-17 | 10.0 |
| 18 | B-1 | 66.4 | E-1 | 30.6 | C-18 | 3.0 |
| 19 | B-1 | 66.1 | E-1 | 30.9 | C-19 | 3.0 |
| 20 | B-1 | 67.8 | E-1 | 29.3 | C-20 | 3.0 |
| 21 | B-1 | 66.4 | E-1 | 30.7 | C-21 | 3.0 |

Comparative Example 1

As materials for a surface layer, i.e., Ion conducting agent C-22 (3.0 parts by mass), Isocyanate group-terminated prepolymer B-1 (67.0 parts by mass), and urethane resin fine particles (trade name, Art-pearl C-400; available from Negami Chemical Industrial Co., Ltd.) (90.0 parts by mass) were mixed with Polyol E-1 (poly(tetramethylene glycol), available from Mitsubishi Chemical Corporation) (30.0 parts by mass) by stirring.

Except for this, a coating material for forming a surface layer was prepared in the same manner as in Example 1 to prepare a coating material for forming a surface layer in Comparative Example 1. The coating material for forming a surface layer was applied to the surface of a silicone rubber elastic layer of Elastic roller D-1, and was dried in the same manner as in Example 1 to form a surface layer. An electrophotographic member in Comparative Example 1 was prepared.

Comparative Examples 2 to 9

Coating materials for forming a surface layer were prepared in the same manner as in Example 1 except that the materials for a surface layer in Example 1, i.e., the reactive compound, the polyol, and the ion conducting agent used as the materials for a surface layer in Example 1 were varied as shown in Table 19. The same amount of the urethane resin fine particles (trade name, Art-pearl C-400; available from Negami Chemical Industrial Co., Ltd.) as that in Example 1 (90.0 parts by mass) was used. The coating materials each were applied to elastic rollers, were dried, and were heated in the same manner as in Example 1 to prepare electrophotographic members in Comparative Examples 2 to 9.

TABLE 19

| Comparative Example | Reactive compound | Reactive compound (Parts by mass) | Polyol | Polyol (Parts by mass) | Ion conducting agent | Amount of ion conducting agent to be added (Parts by mass) |
|---|---|---|---|---|---|---|
| 1 | B-1 | 67.0 | E-1 | 30.0 | C-22 | 3.0 |
| 2 | B-1 | 87.1 | E-3 | 3.0 | C-23 | 10.0 |
| 3 | B-1 | 89.8 | Not added | 0.0 | C-24 | 10.4 |
| 4 | B-2 | 65.1 | E-1 | 34.4 | C-25 | 0.5 |
| 5 | B-2 | 76.9 | E-4 | 20.8 | C-26 | 3.0 |
| 6 | B-4 | 54.9 | E-4 | 42.1 | C-27 | 3.0 |
| 7 | B-1 | 64.8 | E-1 | 32.3 | C-28 | 3.0 |
| 8 | B-1 | 73.8 | E-1 | 23.7 | C-29 | 3.0 |
| 9 | B-1 | 67.7 | E-1 | 29.4 | C-30 | 3.0 |

The results of evaluations on the current value of the developing roller and ghost and the configurations of the resins and the anions in Examples 1 to 21 and Comparative Examples 1 to 9 are shown in Table 20.

TABLE 20

| Example | Ion conducting agent | Cationic Skeleton | Substituent having hydroxyl group 1 | Substituent having hydroxyl group 2 | Anion | Current value of developing roller (μA) | Evaluation of ghost |
|---|---|---|---|---|---|---|---|
| Example 1 | C-1 | Imidazolium | $C_2H_4OH$ | $C_2H_4OH$ | $(CF_3SO_2)_2N^-$ | 32 | A |
| Example 2 | C-2 | | $C_2H_4OH$ | $C_2H_4OH$ | $(CF_3SO_2)_2N^-$ | 19 | A |
| Example 3 | C-3 | | $C_2H_4OH$ | $C_2H_4OH$ | $ClO_4^-$ | 26 | A |
| Example 4 | C-4 | | $(C_2H_4O)_3H$ | $C_4H_8OH$ | $(C_2O_4)_2B^-$ | 23 | A |
| Example 5 | C-5 | | $C_6H_{12}OH$ | $C_8H_{16}OH$ | $CF_3SO_3^-$ | 21 | A |
| Example 6 | C-6 | | $C_8H_{16}OH$ | $C_{10}H_{20}OH$ | $(FSO_2)_2N^-$ | 4 | B |
| Example 7 | C-7 | | $C_{11}H_{22}OH$ | $C_{12}H_{24}OH$ | $(CF_3SO_2)_2N^-$ | 3 | B |
| Example 8 | C-8 | | $C_6H_{12}OH$ | $C_6H_{12}OH$ | $(C_4F_9SO_2)_2N^-$ | 33 | A |
| Example 9 | C-9 | | $(C_4H_8O)_2H$ | $C_6H_{12}OH$ | $N(CN)_2^-$ | 21 | A |
| Example 10 | C-10 | | $(C_4H_8O)_4H$ | $C_{12}H_{24}OH$ | $(CF_3SO_2)_3C^-$ | 3 | B |
| Example 11 | C-11 | Pyridinium | $C_2H_4OH$ | $C_2H_4OH$ | $(CF_3SO_2)_2N^-$ | 24 | A |
| Example 12 | C-12 | | $C_2H_4OH$ | $(C_2H_4O)_3H$ | $Cl^-$ | 13 | A |
| Example 13 | C-13 | | $C_6H_{12}OH$ | $CH_2OH$ | $AsF_6^-$ | 21 | A |
| Example 14 | C-14 | | $(C_4H_8O)_2H$ | $C_2H_4OH$ | $CH_3COO^-$ | 17 | A |
| Example 15 | C-15 | | $C_{10}H_{20}OH$ | $C_2H_4OH$ | $CF_3COO^-$ | 2 | B |
| Example 16 | C-16 | | $C_{12}H_{24}OH$ | $C_{10}H_{20}OH$ | $C_3F_7SO_3^-$ | 2 | B |
| Example 17 | C-17 | | $(C_4H_8O)_4H$ | $C_2H_4OH$ | $CF_2(CF_2SO_2)_2N^-$ | 4 | B |
| Example 18 | C-18 | 1H-pyrazolium | $C_2H_4OH$ | $C_2H_4OH$ | $(CF_3SO_2)_2N^-$ | 10 | A |
| Example 19 | C-19 | Quinolinium | $C_6H_{12}OH$ | $C_6H_{12}OH$ | $BF_3(C_2F_5)^-$ | 5 | A |
| Example 20 | C-20 | Thiazolium | $C_6H_{12}OH$ | $C_2H_4OH$ | $PF_6^-$ | 7 | A |
| Example 21 | C-21 | Oxazolium | $C_2H_4OH$ | $C_2H_4OH$ | $SbF_6^-$ | 9 | A |
| Comparative Example 1 | C-22 | Ammonium | $C_2H_4OH$ | $C_2H_4OH$ | $(CF_3SO_2)_2N^-$ | <0.05 | D |
| Comparative Example 2 | C-23 | Piperidinium | $C_2H_4OH$ | $C_2H_4OH$ | $AsF_6^-$ | <0.05 | D |
| Comparative Example 3 | C-24 | Pyrrolidinium | $C_2H_4OH$ | $C_2H_4OH$ | $(C_2O_4)_2B^-$ | <0.05 | D |
| Comparative Example 4 | C-25 | Morpholinium | $C_2H_4OH$ | $C_2H_4OH$ | $CF_3SO_3^-$ | <0.05 | D |
| Comparative Example 5 | C-26 | Imidazolium | $C_2H_4OH$ | — | $(FSO_2)_2N^-$ | <0.05 | D |
| Comparative Example 6 | C-27 | | $C_2H_4OH$ | $C_6H_{12}OH$ | $(C_4F_9SO_2)_2N^-$ | <0.05 | D |
| Comparative Example 7 | C-28 | | $C_6H_{12}OH$ | — | $(CF_3SO_2)_2N^-$ | <0.05 | D |

TABLE 20-continued

| Example | Ion conducting agent | Cationic Skeleton | Substituent having hydroxyl group 1 | Substituent having hydroxyl group 2 | Anion | Current value of developing roller (μA) | Evaluation of ghost |
|---|---|---|---|---|---|---|---|
| Comparative Example 8 | C-29 | Pyridinium | $C_2H_4OH$ | $C_2H_4OH$ | $N(CN)_2^-$ | <0.05 | D |
| Comparative Example 9 | C-30 | | $C_6H_{12}OH$ | $C_6H_{12}OH$ | $(FSO_2)_2N^-$ | <0.05 | D |

The electrophotographic members in Examples 1 to 21, which include the surface layers containing the resin according to the present invention, attain high-quality images.

In particular, in the resins in Examples 1 to 5, 8, 9, 11, 12, 14, and 18 to 21, the substituent bonded to a hydroxyl group included in the cation of the ion conducting agent has a terminal hydroxyl group and an oxyalkylene structure having 2 to 8 carbon atoms. Electrophotographic members including such surface layers containing the resin according to the present invention have high electro-conductivity to attain high-quality images.

Furthermore, the resins in Examples 1 to 5, 8, 9, 11, 12, and 14 contain an ion conducting agent whose cation has one of an imidazolium structure and a pyridinium structure. Electrophotographic members including such surface layers containing such a resin have particularly high electro-conductivity to attain high-quality images.

In contrast, the resins in Comparative Examples 1 to 4 do not have a nitrogen-containing aromatic heterocyclic cation in the ion conducting agent, and thus the electrophotographic members containing such resins have low electro-conductivity, resulting in deficits in images.

The resins in Comparative Examples 5 to 9, the substituent contained in the cation of the ion conducting agent and bonded to a hydroxyl group is bounded to an atom other than a nitrogen atom of the nitrogen-containing aromatic heterocycle of the cation. In Comparative Examples 5 to 7, the nitrogen-containing aromatic heterocycle in the cation has two or more nitrogen atoms, and one or both of the two substituents bonding to the hydroxyl group is not bonded to the nitrogen atom. In Comparative Examples 8 to 9, the nitrogen-containing aromatic heterocycle in the cation has only one nitrogen atom, and both of the two substituents bonding to the hydroxyl group is not bonded to the nitrogen atom. For this reason, the electrophotographic members containing such resins have low electro-conductivity, resulting in deficits in images.

Example 22

A coating material for forming a surface layer was prepared in the same manner as in Example 1. The coating material for forming a surface layer was applied, was dried, and was heated in the same manner as in Example 1 except that Elastic roller D-1 was replaced with Elastic roller D-2. An electrophotographic member in Example 22 was prepared.

Comparative Example 10

An electrophotographic member in Comparative Example 10 was prepared in the same manner as in Example 22 except that the materials in Comparative Example 1 were used as the material for a surface layer.

The electrophotographic members in Example 22 and Comparative Example 10 were used as a charging member (charging roller) for evaluation of the following items.

[Current Value of Charging Roller]

The electrophotographic members as a charging roller were left to stand in an N/N environment for 6 hours or longer, and the current value of the charging roller was measured under the N/N environment.

FIGS. 4A and 4B illustrate a schematic configuration of a jig used in evaluation of the current value of the charging roller.

As illustrated in FIG. 4A, while a load of 4.9 N was being applied to both ends of the electro-conductive mandrel 2 of the electrophotographic member 1 as a charging roller through electro-conductive bearings 38, a cylindrical metal 37 having a diameter of 30 mm was rotated at 30 rpm and the electrophotographic member 1 as a charging roller was rotated following the rotation of the cylindrical metal 37.

Next, in FIG. 4B, a voltage of 200 V was applied by a high voltage power supply 39, and the difference in potential between both ends of a resistor disposed between the cylindrical metal 37 and the ground and having a known electric resistance (more than two digits lower than the electric resistance of the charging roller) was determined. The difference in potential was determined with a voltmeter 40 (available from Fluke Corporation, 189 TRUE RMS MULTIMETER). From the difference in potential and the electric resistance of the resistor, the current flowing in the cylindrical metal through the electrophotographic member 1 as a charging roller was calculated. The difference in potential was sampled for 3 seconds after 2 seconds from the application of voltage, and the value calculated from the average of the sampling was defined as the current value of the charging roller.

[Evaluation of Images with Horizontal Streaks]

Low electro-conductivity of the charging roller may appear as uneven density in halftone images in the form of fine stripes (horizontal streaks). Such images are referred to as images with horizontal streaks. Lower electro-conductivity is more likely to cause such images with horizontal streaks.

The electrophotographic members prepared in Examples as charging rollers were each attached to a laser printer (trade name: LBP7700C, available from Canon Inc.) as an electrophotographic apparatus. A halftone image (image of lines each having a width of 1 dot and an interval of 2 dots in the rotational direction and the vertical direction for the rotational direction, respectively, of the photosensitive member) was output. The printed images were visually observed to evaluate uneven density, which appeared in the form of fine stripes (horizontal streaks). The results of evaluation are shown in Table 21. The horizontal streaks were evaluated according to the following criteria.

A: no horizontal streaks occur.

B: horizontal streaks slightly occur only ends of an image.

C: horizontal streaks remarkably occur almost a half of an image.

TABLE 21

| Example | Ion conducting agent | Cationic skeleton | Substituent having hydroxyl group 1 | Substituent having hydroxyl group 2 | Anion | Current value of charging roller (μA) | Evaluation of horizontal streaks |
|---|---|---|---|---|---|---|---|
| Example 22 | C-1 | Imidazolium | $C_2H_4OH$ | $C_2H_4OH$ | $(CF_3SO_2)_2N^-$ | 130 | A |
| Comparative Example 10 | C-22 | Ammonium | $C_2H_4OH$ | $C_2H_4OH$ | $(CF_3SO_2)_2N^-$ | 0.1 | C |

The electrophotographic member in Example 22, which includes the surface layer containing the resin according to the present invention, has high electro-conductivity to attain high-quality images.

In contrast, the resin in Comparative Example 10 does not have a nitrogen-containing aromatic heterocyclic cation in the ion conducting agent, and thus the electrophotographic member containing such a resin has low electro-conductivity, resulting in deficits in images.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-102661, filed May 16, 2014, and Japanese Patent Application No. 2015-097741, filed May 12, 2015, which are hereby incorporated by reference herein in their entirety.

What is claimed is:

1. An electrophotographic member, comprising an electro-conductive mandrel and an electro-conductive layer, the electro-conductive layer comprising an anion and a resin having a structure represented by Formula (1)

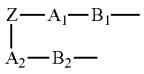

(1)

wherein Z represents a cationic skeleton comprising a cationic nitrogen-containing aromatic heterocycle, $A_1$ and $A_2$ independently represent a linking group and are bonded to a nitrogen atom of the cationic nitrogen-containing aromatic heterocycle in Z, with the proviso that (i) one of $A_1$ and $A_2$ bonds to the nitrogen atom, and the other of $A_1$ and $A_2$ bonds to a carbon atom in the cationic nitrogen-containing aromatic heterocycle when the cationic nitrogen-containing aromatic heterocycle has only one nitrogen atom and (ii) $A_1$ and $A_2$ bond to two nitrogen atoms in the cationic nitrogen-containing aromatic heterocycle when the cationic nitrogen-containing aromatic heterocycle has two or more nitrogen atoms, and $B_1$ and $B_2$ independently represent a residue of a reaction of the hydrogen atom of a hydroxyl group with a compound capable of reacting with the hydrogen atom of the hydroxyl group, and at least one of $B_1$ or $B_2$ comprises a residue of a reaction of the hydrogen atom of a hydroxyl group with at least one compound selected from the group consisting of an isocyanate compound, an epoxide compound and a melamine compound.

2. The electrophotographic member according to claim 1, wherein the linking group has an oxyalkylene structure.

3. The electrophotographic member according to claim 2, wherein the oxyalkylene structure is represented by Formulae (I) or (II):

$$**-(CH_2)_a O-* \quad (I)$$

$$**-((CH_2)_b O)_2-* \quad (II)$$

wherein * represents a bonding site to the residue,

** represents a bonding site to the nitrogen atom, a is an integer of 1 to 9, and b is an integer of 1 to 4.

4. The electrophotographic member according to claim 1, wherein Z comprises a cationic imidazolium skeleton or a cationic pyridinium skeleton.

5. The electrophotographic member according to claim 1, wherein the anion is at least one member selected from the group consisting of a fluorosulfonic acid anion, a fluorocarboxylic acid anion, a fluorosulfonylimide anion, a fluorosulfonylmethide anion, a fluoroalkylfluoroboric acid anion, a fluoroalkylfluorophosphoric acid anion, a tetrafluoroboric acid anion, a hexafluorophosphoric acid anion, a hexafluoroarsenic acid anion, a hexafluoroantimonic acid anion, a dicyanamide anion, and a bis(oxalato)boric acid anion.

6. An electrophotographic member according to claim 1, wherein the resin is synthesized from a nitrogen-containing aromatic heterocyclic cation and at least one compound selected from the group consisting of an isocyanate compound, an epoxide compound and a melamine compound, and the nitrogen-containing aromatic heterocyclic cation has two substituents bonded to hydroxyl groups, with the proviso that (i) one of the substituents bonds to the nitrogen atom, and the other substituent bonds to a carbon atom in the nitrogen-containing aromatic heterocycle when the nitrogen-containing aromatic heterocycle in the nitrogen-containing aromatic heterocyclic cation has only one nitrogen atom, and (ii) the substituents bond to two nitrogen atoms in the nitrogen-containing aromatic heterocycle when the nitrogen-containing aromatic heterocycle in the nitrogen-containing aromatic heterocyclic cation has two or more nitrogen atoms.

7. The electrophotographic member according to claim 6, wherein the substituent bonded to the hydroxyl group has an oxyalkylene structure between the hydrogen atom of the hydroxyl group and the nitrogen atom.

8. The electrophotographic member according to claim 7, wherein the oxyalkylene structure is represented by Formulae (III) or (IV):

$$**-(CH_2)_c O-* \quad (III)$$

$$**-((CH_2)_d O)_2-* \quad (IV)$$

wherein *** represents a bonding site to the hydrogen atom of the hydroxyl group,

**** represents a bonding site to the nitrogen atom, c is an integer of 1 to 9, and d is an integer of 1 to 4.

9. The electrophotographic member according to claim 6, wherein the nitrogen-containing aromatic heterocyclic cation is an imidazolium cation or a pyridinium cation.

10. The electrophotographic member according to claim 6, wherein the anion is at least one member selected from the group consisting of a fluorosulfonic acid anion, a fluorocarboxylic acid anion, a fluorosulfonylimide anion, a fluorosulfonylmethide anion, a fluoroalkylfluoroboric acid anion, a fluoroalkylfluorophosphoric acid anion, a tetrafluoroboric acid anion, a hexafluorophosphoric acid anion, a hexafluoroarsenic acid anion, a hexafluoroantimonic acid anion, a dicyanamide anion, and a bis(oxalato)boric acid anion.

11. A process cartridge detachably attached to a main body of an electrophotographic apparatus and comprising at least one of a charging member and a developer carrying member, wherein the charging member or the developer carrying member is the electrophotographic member according to claim 6.

12. An electrophotographic apparatus, comprising an electrophotographic photosensitive member, a charging member, and a developer carrying member, wherein the charging member or the developer carrying member is the electrophotographic member according to claim 6.

13. The electrophotographic member according to claim 1, wherein $B_1$ and $B_2$ both independently comprise said residue of a reaction of the hydrogen atom of a hydroxyl group with at least one compound selected from the group consisting of an isocyanate compound, an epoxide compound and a melamine compound.

* * * * *